US011536506B2

(12) United States Patent
Fisher et al.

(10) Patent No.: US 11,536,506 B2
(45) Date of Patent: Dec. 27, 2022

(54) TEMPERATURE CONTROLLED DISPENSE DRAWER

(71) Applicant: Omnicell, Inc., Mountain View, CA (US)

(72) Inventors: Herbert Lawson Fisher, Portola Valley, CA (US); Edith Wilson, Healdsburg, CA (US); Dean Fambro, Fremont, CA (US); Brian Arnold, Santa Cruz, CA (US); Brad Basler, Redwood City, CA (US); Vihar Kapadia, San Francisco, CA (US); Sunil Belligundu, Campbell, CA (US)

(73) Assignee: OMNICELL, INC., Mountain View, CA (US)

( * ) Notice: Subject to any disclaimer, the term of this patent is extended or adjusted under 35 U.S.C. 154(b) by 418 days.

(21) Appl. No.: 16/129,579

(22) Filed: Sep. 12, 2018

(65) Prior Publication Data

US 2020/0080762 A1 Mar. 12, 2020

(51) Int. Cl.
*F25D 13/02* (2006.01)
*F25D 25/02* (2006.01)
(Continued)

(52) U.S. Cl.
CPC ..... *F25D 13/02* (2013.01); *F25D 17/045* (2013.01); *F25D 25/025* (2013.01);
(Continued)

(58) Field of Classification Search
CPC ..... F25D 11/022; F25D 13/02; F25D 19/02; F25D 23/003; F25D 27/005;
(Continued)

(56) References Cited

U.S. PATENT DOCUMENTS 3,364,694 A 1/1968 Cohen et al.
5,190,185 A 3/1993 Blechl
(Continued)

FOREIGN PATENT DOCUMENTS

CN 1301337 A 6/2001
CN 1335924 A 2/2002
(Continued)

OTHER PUBLICATIONS

U.S. Appl. No. 15/816,775 received a Non-final Office Action dated Aug. 21, 2019, 16 pages.
(Continued)

*Primary Examiner* — Nelson J Nieves
(74) *Attorney, Agent, or Firm* — Kilpatrick Townsend & Stockton LLP

(57) ABSTRACT

A device for dispensing items includes a cabinet, and a drawer within the cabinet. The drawer includes one or more compartments for storing items and a cooling system within the drawer. The cooling system is configured to maintain the one or more compartments in the drawer at a temperature below the temperature of the environment surrounding the cabinet. The drawer further includes thermal insulation at sides of the drawer and thermal insulation beneath the one or more compartments. The refrigeration system may be a thermoelectric cooling system.

29 Claims, 25 Drawing Sheets

(51) Int. Cl.
*F25D 17/04* (2006.01)
*F25D 29/00* (2006.01)

(52) U.S. Cl.
CPC ..... *F25D 25/028* (2013.01); *F25D 29/006* (2013.01); *F25D 2201/10* (2013.01); *F25D 2317/0682* (2013.01); *F25D 2700/121* (2013.01); *F25D 2700/16* (2013.01)

(58) Field of Classification Search
CPC ..... F25D 2317/061; F25D 2400/361; F25D 2700/12; F25D 2700/121; F25D 23/069
See application file for complete search history.

(56) References Cited

U.S. PATENT DOCUMENTS 5,377,864 A 1/1995 Blechl et al.
5,501,076 A * 3/1996 Sharp, III ..... F25B 21/02 62/3.2
5,661,978 A 9/1997 Holmes et al.
5,745,366 A 4/1998 Higham et al.
5,805,455 A 9/1998 Lipps
5,805,456 A 9/1998 Higham et al.
5,905,653 A 5/1999 Higham et al.
5,927,540 A 7/1999 Godlewski
6,011,999 A 1/2000 Holmes
6,039,467 A 3/2000 Holmes
6,112,547 A 9/2000 Spauschus et al.
6,151,536 A 11/2000 Arnold et al.
6,170,929 B1 1/2001 Wilson et al.
6,272,394 B1 8/2001 Lipps
6,385,505 B1 5/2002 Lipps
6,530,231 B1 * 3/2003 Nagy ..... F25B 21/02 136/203
6,609,047 B1 8/2003 Lipps
6,640,159 B2 10/2003 Holmes et al.
6,760,643 B2 7/2004 Lipps
6,975,922 B2 12/2005 Duncan et al.
7,348,884 B2 3/2008 Higham
7,571,024 B2 8/2009 Duncan et al.
7,675,421 B2 3/2010 Higham
7,835,819 B2 11/2010 Duncan et al.
8,126,590 B2 2/2012 Vahlberg et al.
8,196,939 B2 6/2012 Bustle et al.
8,280,550 B2 10/2012 Levy et al.
8,991,194 B2 3/2015 Edwards et al.
8,997,517 B2 4/2015 Bertolini et al.
9,013,309 B2 * 4/2015 Hussain ..... G06K 7/10178 340/572.1
9,078,520 B2 7/2015 Shoenfeld
9,242,732 B2 1/2016 Aurekoski
9,595,241 B2 3/2017 Zhu et al.
9,605,888 B2 * 3/2017 Shin ..... F25D 11/00
10,362,866 B2 * 7/2019 Duval ..... A47B 96/00
10,604,967 B2 3/2020 Sciacchitano et al.
10,663,218 B2 5/2020 Belligundu
2002/0121095 A1 9/2002 Adamski et al.
2003/0084670 A1 * 5/2003 Kim ..... F25D 29/00 62/3.6
2003/0115892 A1 6/2003 Fu et al.
2006/0016202 A1 1/2006 Lyvers et al.
2007/0199262 A1 * 8/2007 Kern ..... A61B 5/02055 52/234
2007/0228899 A1 * 10/2007 McFarland ..... G07F 17/0092 312/221
2008/0148765 A1 6/2008 Barone et al.
2008/0264962 A1 * 10/2008 Schifman ..... G07F 17/0092 221/1
2009/0187274 A1 7/2009 Higham
2009/0212670 A1 8/2009 Bustle et al.
2009/0302178 A1 * 12/2009 Hampe ..... F16M 11/24 248/187.1
2010/0147001 A1 6/2010 Kim et al.
2010/0300130 A1 * 12/2010 Shoenfeld ..... G07F 17/0092 62/129
2011/0101018 A1 5/2011 Shafir
2012/0137706 A1 * 6/2012 Hussain ..... A61J 1/00 62/3.6
2012/0191241 A1 7/2012 Rahilly et al.
2012/0203377 A1 8/2012 Paydar et al.
2012/0304667 A1 * 12/2012 Shin ..... F25B 21/02 62/3.6
2012/0330462 A1 * 12/2012 Maroney ..... H05K 7/1498 700/237
2013/0030566 A1 1/2013 Shavelsky et al.
2013/0123974 A1 * 5/2013 Clarke ..... G07F 17/0092 700/236
2013/0276465 A1 10/2013 Shin et al.
2015/0233648 A1 8/2015 Goseling
2016/0054047 A1 2/2016 Lim et al.
2016/0196798 A1 7/2016 Zhu et al.
2016/0377329 A1 12/2016 Shin et al.
2016/0379022 A1 * 12/2016 Elizondo, II ..... G06Q 10/087 340/10.1
2017/0205134 A1 7/2017 Osbar et al.
2019/0003757 A1 * 1/2019 Miros ..... G01S 19/13
2020/0003462 A1 * 1/2020 Sul ..... F25D 15/00

FOREIGN PATENT DOCUMENTS

CN 1627010 A 6/2005
CN 202092793 U 12/2011
CN 102582950 A 7/2012
CN 203133951 U 1/2013
CN 106979645 A 7/2017
EP 2 551 618 A2 7/2013
FR 2797684 A1 2/2001
JP 5839349 Y2 9/1983
JP 60-102482 A 6/1985
JP 0526563 A 2/1993
JP 10-248658 A 9/1998
JP 2001091173 A 4/2001
JP 2014500210 A 1/2014
JP 2015521272 A 7/2015
WO 2012/075449 A2 6/2012

OTHER PUBLICATIONS

"The Importance of Using Glycol-Encased Temperature Probes" accucold for Summit Appliance, Nov. 4, 2017, [online] <retrieved from URL: http://www.accucold.com/glycolbasedprobes> entire document.
PCT/US2018/061426 received an International Search Report and Written Opinion dated Mar. 27, 2019, 16 pages.
Chinese Application No. CN201880074315.7 received an Office Action dated Jul. 19, 2021,11 pages, no English translation available.

* cited by examiner

TEMPERATURE CONTROLLED DISPENSE DRAWER

BACKGROUND OF THE INVENTION

Many industries rely on the accurate inventory and dispensing of secure items. For example, in a hospital setting, it is of paramount importance that patients be given the correct medications in the correct doses. In addition, it is legally required that controlled substances be secured and accurately tracked, and it is also important that inventories of medications and supplies be tracked so that proper business controls can be implemented.

Different medications may have different storage requirements. For example, some medications or supplies may require refrigeration, while others do not. Items requiring refrigeration may present special difficulties, as they are typically simply stored in a refrigerator. Even though the refrigerator may be locked, once the refrigerator is accessed, all items in the refrigerator are accessible and subject to mistaken retrieval, diversion, or other problems.

BRIEF SUMMARY OF THE INVENTION

According to one aspect, a device for dispensing items comprises cabinet and a drawer within the cabinet. The drawer includes one or more compartments for storing items and a cooling system within the drawer. The cooling system is configured to maintain the one or more compartments in the drawer at a temperature below the temperature of the environment surrounding the cabinet. The drawer further comprises thermal insulation at sides of the drawer and thermal insulation beneath the one or more compartments. In some embodiments, the cooling system comprises a compressor, a condenser, and an evaporator. In some embodiments, the cooling system is a thermoelectric cooling system. In some embodiments, the thermoelectric cooling system further comprises a fan configured to circulate air within the drawer. In some embodiments, the thermoelectric cooling system further comprises a fan configured to both exhaust heat from the thermoelectric cooling unit and to cause airflow under or around the thermal insulation of the drawer. In some embodiments, at least some of the compartments are defined by perforated walls that permit circulating air to pass through the walls and through the compartments. In some embodiments, lids of at least some compartments whose walls are perforated include descending ribs that protrude into the compartments when the lids are closed. In some embodiments, the device further comprises a computerized controller coupled to the drawer, the controller controlling access to the drawer. In some embodiments, the device further comprises a temperature probe within the drawer, and the temperature probe provides a signal to the computerized controller indicating a temperature within the drawer. In some embodiments, the device further comprises one or more actuators controllable by the computerized controller and coupled to lids of respective ones of the one or more compartments, and the one or more actuators are disposed outside of an interior of the drawer defined by the thermal insulation at the sides of the drawer and the thermal insulation beneath the one or more compartments. In some embodiments, the device further comprises magnetic latches on at least some of the compartments, the magnetic latches controlled by the computerized controller to lock and unlock the lids of their respective compartments. In some embodiments, each of the magnetic latches comprises a permanent magnet fixed to the lid of the respective compartment and an electromagnet fixed to a wall of the compartment such that the permanent magnet contacts the electromagnet when the lid is closed, and the controller unlocks the compartment by causing current to pass through the electromagnet, causing the electromagnet to repel the permanent magnet. In some embodiments, the one or more actuators comprise one or more solenoids. In some embodiments, the device further comprises one or more sensors configured to sense the positions of lids of respective ones of the one or more compartments. In some embodiments, each of the sensors is disposed outside of the interior of the drawer defined by the thermal insulation at the sides of the drawer and the thermal insulation beneath the one or more compartments, and is coupled to its respective lid. In some embodiments, each of the sensors is coupled to its respective lid via a linkage that passes through the thermal insulation of the drawer. In some embodiments, each of the sensors is coupled to its respective lid via a sheathed cable that passes through the thermal insulation of the drawer. In some embodiments, the device further comprises one or more lights corresponding respectively to at least some of the one or more compartments, and the controller is configured to, upon determination that a particular compartment is to be accessed: actuate one of the actuators corresponding the particular compartment to unlock the particular compartment; and illuminate one of the lights corresponding to the particular compartment. In some embodiments, the device further comprises an override mechanism accessible from outside the drawer, the override mechanism mechanically moving the one or more actuators to unlock one or more of the compartments manually. In some embodiments, the thermoelectric cooling system comprises a closed cooling loop containing a heat transfer fluid. In some embodiments, the heat transfer fluid is maintained at a pressure such that its boiling point is at approximately the desired temperature of the inside of drawer. In some embodiments, the heat transfer fluid is maintained at a pressure such that its boiling point is between 2° C. and 8° C. The heat transfer fluid may be carbon dioxide. In some embodiments, the thermoelectric cooling system, including the closed cooling loop and the heat transfer fluid, forms a heat pipe that operates by natural convection.

According to another aspect, a drawer, comprises an outer shell, insulation defining a climate-controlled interior of the drawer, and a thermoelectric cooling system disposed in a side wall of the drawer. The thermoelectric cooling system is configured to maintain interior of the drawer at a temperature below the temperature of the environment surrounding the drawer/The drawer further comprises a set of walls defining one or more compartments within the climate-controlled interior of the drawer, one or more lids covering the one or more compartments. An electrical interface for receiving power and control signals, and one or more actuators coupled to the one or more lids for locking and unlocking the one or more compartments in response to control signals received via the electrical interface. In some embodiments, the one or more actuators are disposed outside the climate-controlled interior of the drawer. In some embodiments, the drawer further comprises one or more lights corresponding to the one or more compartments, the lights being responsive to control signals received via the electrical interface. In some embodiments, the thermoelectric cooling system is configured to circulate cooled air in the interior of the drawer. In some embodiments, the thermoelectric cooling system includes a closed cooling loop containing a heat transfer fluid. In some embodiments, the heat transfer fluid is carbon dioxide maintained at a pressure such that its boiling point is between 2° C. and 8° C.

DETAILED DESCRIPTION OF THE INVENTION

Figure 1:
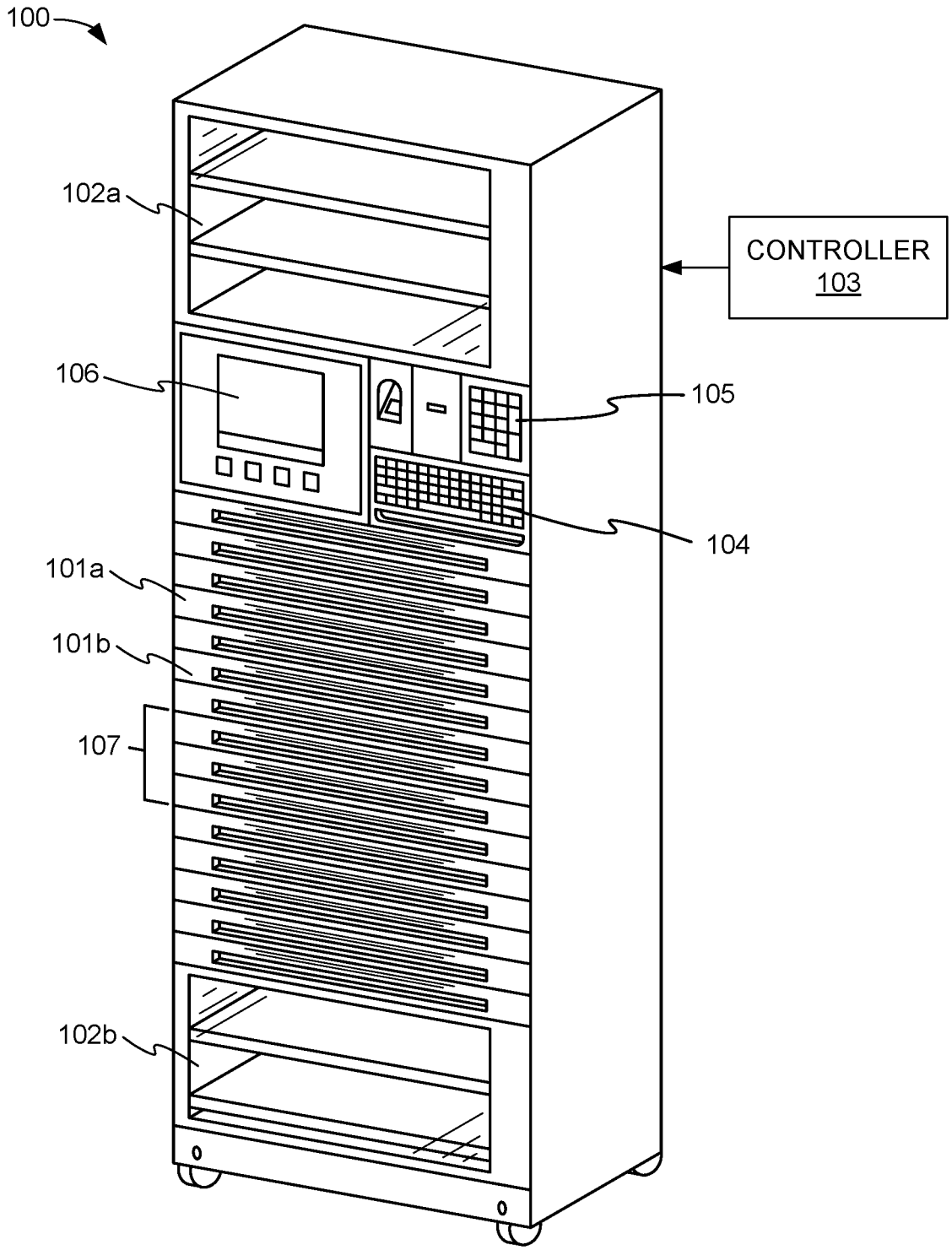
FIG. 1 illustrates a dispensing cabinet in which the invention may be embodied.

FIG. 1 illustrates a dispensing cabinet 100 in accordance with embodiments of the invention. Cabinet 100 includes a plurality of compartments, including drawers 101*a*, 101*b*, and 107, and compartments accessible through doors 102*a* and 102*b*. Dispensing cabinet 100 also includes a computerized controller 103, and one or more data entry devices such as keyboard 104 and keypad 105. A display 106 enables communication of information to a user of dispensing cabinet 100. In accordance with embodiments of the invention, drawer 107 includes a refrigeration system as discussed in more detail below. In some embodiments, a dispensing cabinet may include other devices as well.

While devices embodying the invention may be used in a variety of applications, embodiments may be particularly useful in the medical field. For example, dispensing cabinet 100 may hold medications or medical supplies, and may facilitate the accurate dispensing and tracking of medications or other medical supplies.

Computerized controller 103 may include a processor, memory, input/output interfaces, and other components. Controller 103 may communicate remotely with other computerized systems, such as medical records systems, inventory and accounting systems, and the like.

The various storage compartments such as drawers 101*a*, 101*b*, and 107 may be under the control of controller 103. For example, each of drawers 101*a*, 101*b*, and 107 may include an electronically-controllable locking mechanism, and may only be openable under the control of controller 103. In addition, controller 103 may store information about what supplies are stored in which compartments of medication storage cabinet 100. In one typical basic usage scenario, a health care worker may enter, using keyboard 104 or another input device, an identification of a patient who is under the care of the health care worker, and who will need medication during the worker's current rounds. Controller 103 may access the patient's medical file and determine what medications have been prescribed for that patient. Controller 103 may then permit access only to the drawer or drawers containing the prescribed medications for the patient. A particular compartment such as a bin within the correct drawer may also be highlighted, for example with a lighted indicator, to draw the health care worker to the correct medication. The health care worker can then remove the patient's prescribed medication. The level of control exercised by controller 103 may help in preventing medication and dosing errors, by reducing the likelihood that a health care worker will remove an incorrect medication from medication dispensing cabinet 100. In addition, controller 103 may document and record which medication was dispensed, and may forward that information via a wired or wireless electronic network to inventory and accounting systems.

Many other features and functions are possible as well. For example, the health care worker may enter his or her identification as well, and controller 103 may provide access only to those medications and supplies for which the worker is authorized to access.

While medication dispensing cabinet 100 is shown as a stationary device, the invention is not so limited. Cabinets according to other embodiments may be portable, for example to facilitate transporting medications and supplies from a central supply store to a particular ward or department of a facility. It will be recognized that the particular arrangement of drawers, doors, or other features of a cabinet according to embodiments of the invention may be varied. For example, some cabinets or dispensing carts embodying the invention may use only drawers. Many different sizes and styles of compartments may be used, depending on the sizes of materials to be dispensed, and the level of security required for them.

A cabinet embodying the invention may include guides or mounting features spaced a standardized distance apart, and different drawers may span different multiples of the spacing distance. A drawer spanning only the spacing distance may be called a "single" height drawer. A drawer spanning two of the spacing distance may be called a "double" height drawer. Triple height and taller drawers are also possible. A cabinet such as cabinet 100 may be configured with combinations of drawer heights, depending on the sizes of the items to be stored. In the example of FIG. 1, drawer 101*b* is a single height drawer, while drawer 107 is a triple height drawer.

Figure 2:
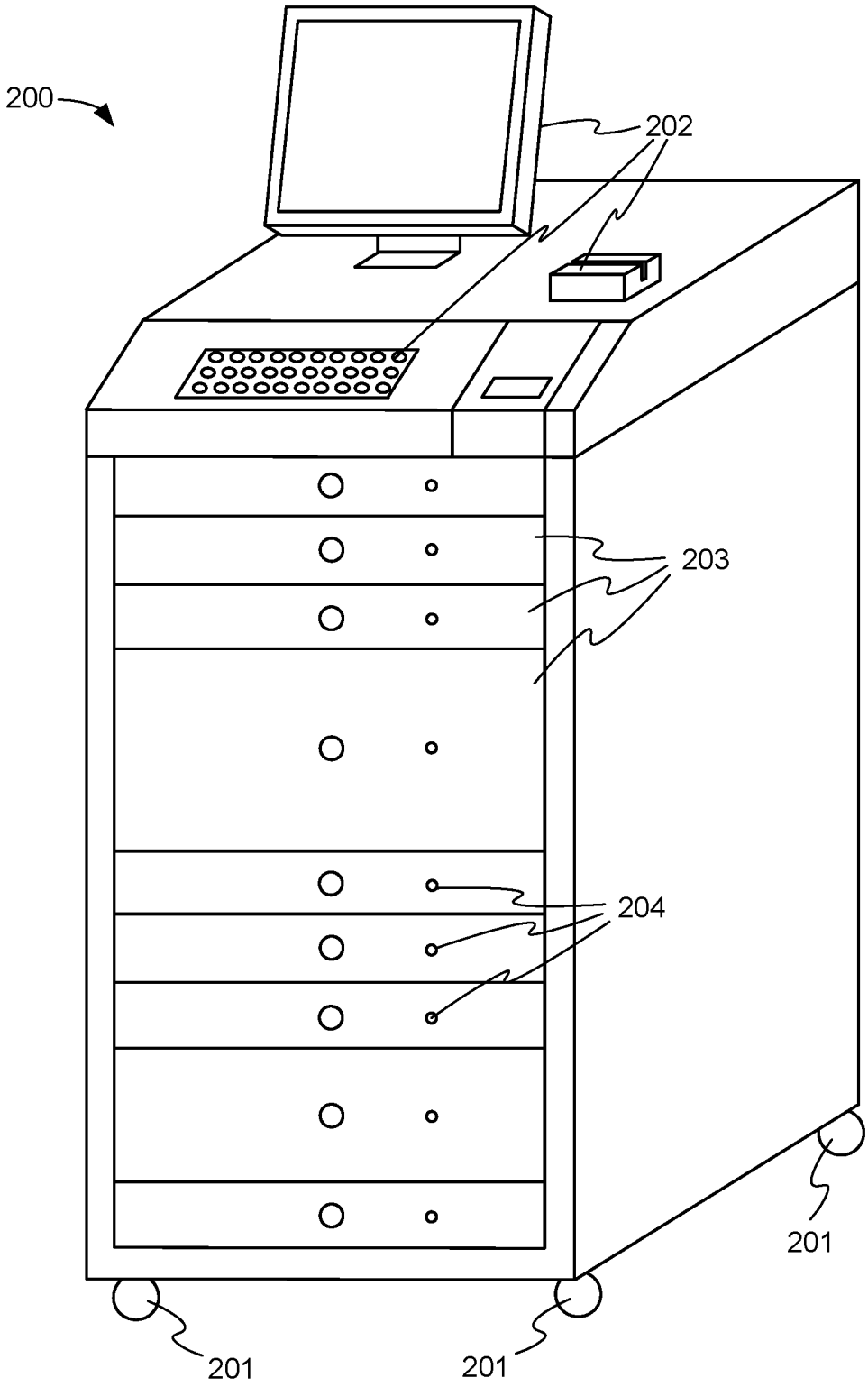
FIG. 2 illustrates a portable dispensing device in which the invention may be embodied.

FIG. 2 illustrates a portable dispensing device 200 in which the invention may be embodied. Preferably, portable dispensing device 200 can perform functions similar to those described above with respect to dispensing cabinet 100. Dispensing device 200 includes wheels 201 to enable a health care worker to wheel the device from room to room. Dispensing device 200 may include one or more batteries, to power a computerized controller that performs tasks similar to controller 103 discussed above, and to provide power for other functions of dispensing device 200. In addition, dispensing device 200 can preferably be connected to mains power when convenient, for charging the batteries and for powering the device without drawing on the battery when the device will be at a particular location for a period of time. Various input/output devices 202 may be provided, and may be especially adapted for portability, for example to minimize power consumption. Dispensing device 200 also includes a number of drawers 203 of varying heights. Each drawer 203 may include a visual indicator 204 for guiding a user to a particular drawer 203, as is explained in more detail below. One or more of drawers 203 may include a refrigeration system in accordance with embodiments of the invention. Other drawers within cabinet 100 may not be refrigerated.

Additional types of dispensing units in which the invention may be embodied or which include features usable with embodiments of the invention are described in the following commonly owned U.S. Patents and patent applications, the contents of which are hereby incorporated by reference: U.S. Pat. No. 6,272,394, issued on Aug. 7, 2001 to Lipps, U.S. Pat. No. 6,385,505, issued on May 7, 2002 to Lipps, U.S. Pat. No. 6,760,643, issued on Jul. 6, 2004 to Lipps, U.S. Pat. No. 5,805,455, issued on Sep. 8, 1998 to Lipps, U.S. Pat. No. 6,609,047, issued on Aug. 19, 2003 to Lipps, U.S. Pat. No. 5,805,456, issued on Sep. 8, 1998 to Higham et al, U.S. Pat. No. 5,745,366, issued on Apr. 28, 1998 to Higham et al., an U.S. Pat. No. 5,905,653, issued on May 18, 1999 to Higham et al., U.S. Pat. No. 5,927,540, issued on Jul. 27, 1999 to Godlewski, U.S. Pat. No. 6,039,467, issued on Mar. 21, 2000 to Holmes, U.S. Pat. No. 6,640,159, issued on Oct. 28, 2003 to Holmes et al., U.S. Pat. No. 6,151,536, issued on Nov. 21, 2000 to Arnold et al., U.S. Pat. No. 5,377,864, issued on Jan. 3, 1995 to Blechl et al., U.S. Pat. No. 5,190,185, issued on Mar. 2, 1993 to Blechl, U.S. Pat. No. 6,975,922, issued on Dec. 13, 2005 to Duncan et al., U.S. Pat. No. 7,571,024, issued on Aug. 4, 2009 to Duncan et al., U.S. Pat. No. 7,835,819, issued on Nov. 16, 2010 to Duncan et al., U.S. Pat. No. 6,011,999, issued on Jan. 4, 2000 to Holmes, U.S. Pat. No. 7,348,884, issued on Mar. 25, 2008 to Higham, U.S. Pat. No. 7,675,421, issued on Mar. 9, 2010 to Higham, U.S. Pat. No. 6,170,929, issued on Jan. 9, 2001 to Wilson et al., U.S. Pat. No. 8,126,590, issued on Feb. 28, 2012 to Vahlberg et al., U.S. Pat. No. 8,280,550, issued in Oct. 2, 2012 to Levy et al., and U.S. Patent Application Publication No. 2012/0203377 of Paydar et al., published on Aug. 9, 2012.

Figure 3:
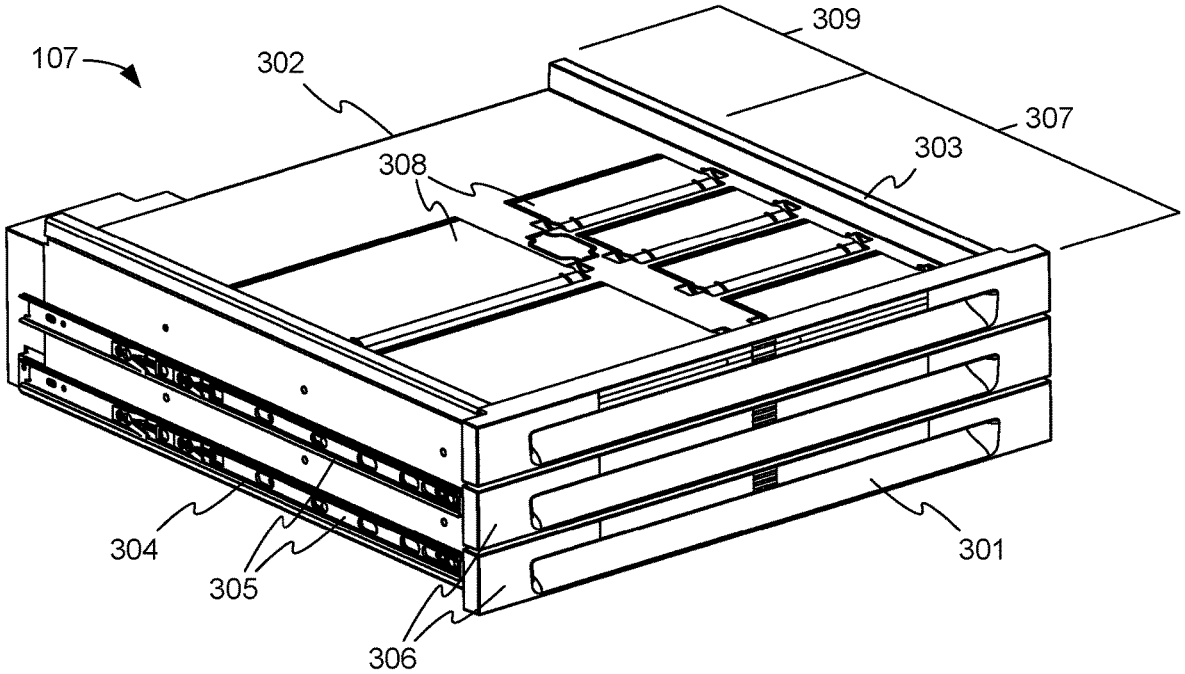
FIG. 3 illustrates a front upper oblique view of a drawer, in accordance with embodiments of the invention.

FIG. 3 illustrates a front upper oblique view of drawer 107 in more detail, in accordance with embodiments of the invention. Drawer 107 has a front side 301, a back side 302, and right and left sides 303 and 304, as viewed from front side 301. Front side 301 is the side that would show at the front of a cabinet once drawer 107 is installed in the cabinet, and is the side from which a user would access drawer 107. Drawer 107 may include guides 305 for mounting drawer 107 into a cabinet such as cabinet 100, and enabling drawer to slide open (in the direction of front side 301) and closed (with drawer 107 substantially entirely within the cabinet). One or more fascia pieces 306 provide a decorative look to the front of drawer 107, may provide an undercut handle for the user to grip in opening drawer 107, and may include other features as described in more detail below.

Front portion 307 of drawer 107 includes a number of compartments, which in FIG. 3 are covered by lids 308. Rear portion 309 houses parts of a refrigeration system, described in more detail below.

Figure 4:
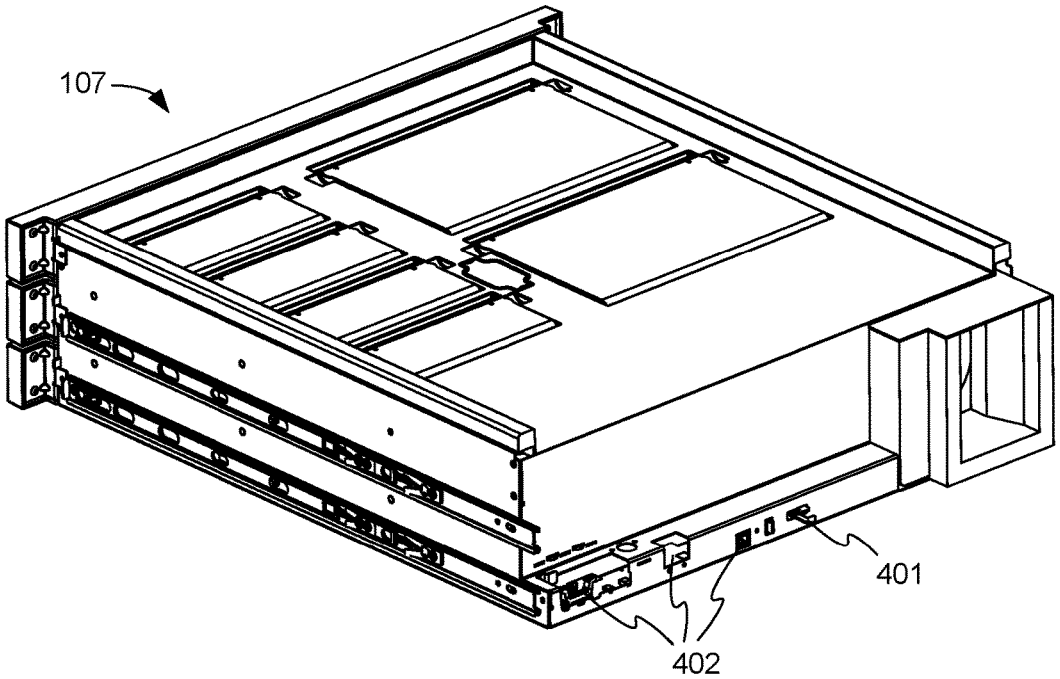
FIG. 4 shows a rear upper oblique view of the drawer of FIG. 3, in accordance with embodiments of the invention.

FIG. 4 shows a rear upper oblique view of drawer 107. A mechanical latch 401 may be provided, which may interact with cabinet 100. For example, controller 103 may control latch so that drawer 107 can be opened only if a worker requesting access to drawer 107 has provided proper credentials. Lids 308 may be similarly controllable, so that only the storage location holding the required medicine or supplies is openable by the worker.

Various electrical connectors 402 may be provided, to which cables (not shown) may be attached, so that drawer 107 can receive electrical power from cabinet 100 and may communicate with controller 103.

Figure 5:
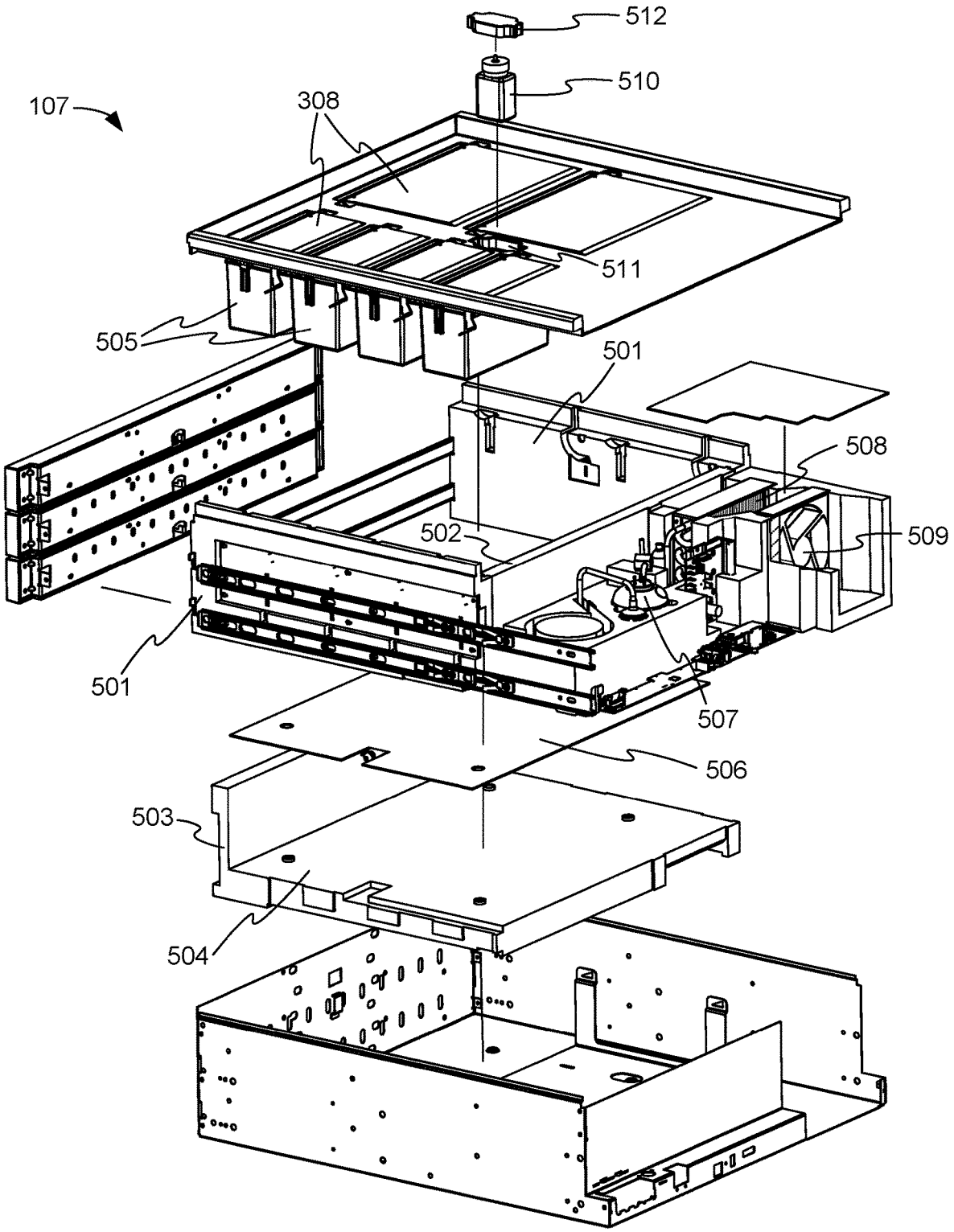
FIG. 5 shows an upper exploded view of the drawer of FIG. 3, in accordance with embodiments of the invention.
Figure 6:
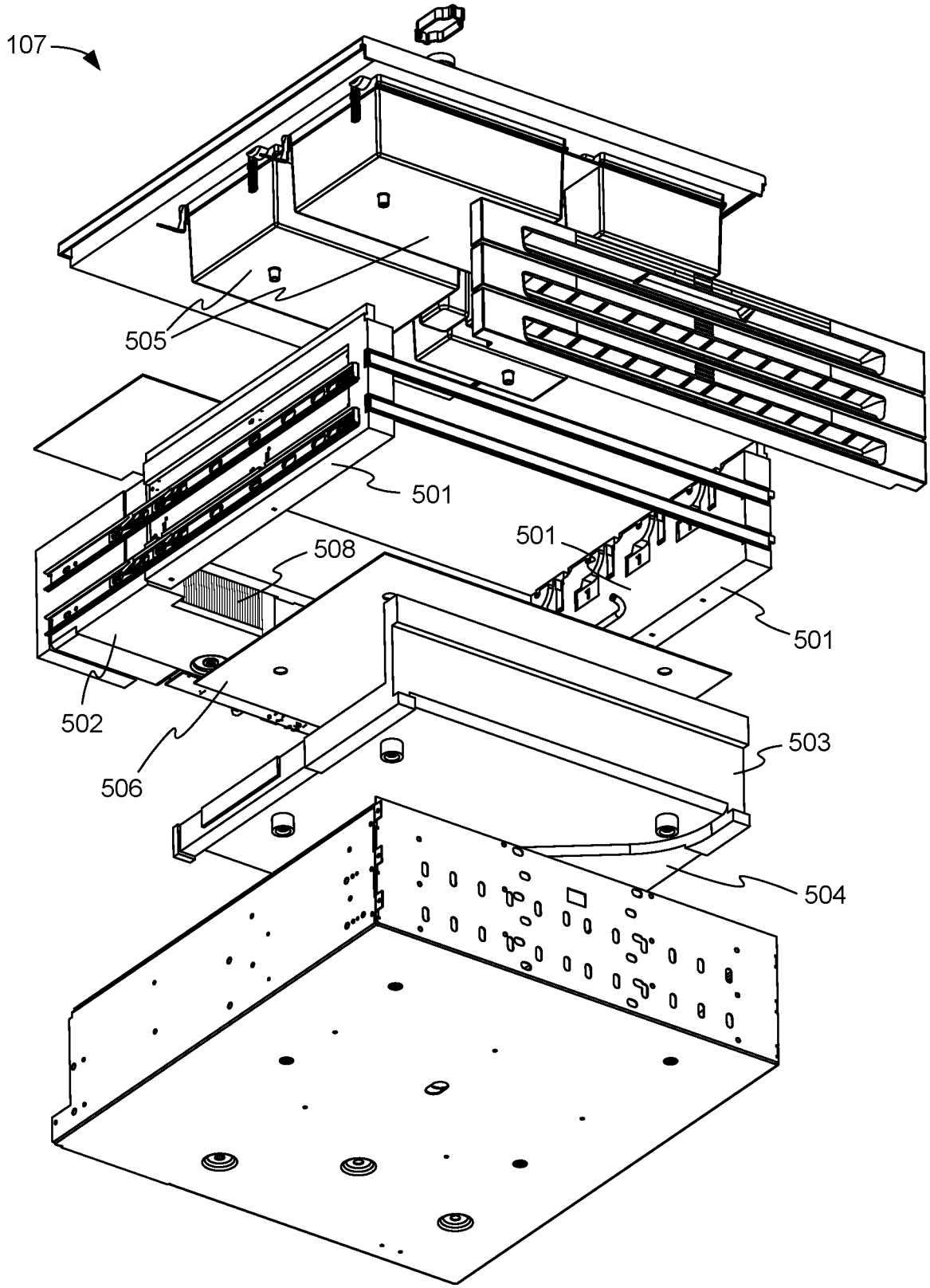
FIG. 6 shows a lower exploded view of the drawer of FIG. 3, in accordance with embodiments of the invention.

FIGS. 5 and 6 show upper and lower exploded views of drawer 107, in accordance with embodiments of the invention. The interior of drawer 107 is essentially surrounded by insulation, including side insulation panels 501, back insulation panel 502, front insulation panel 503, and bottom insulation panel 504. Insulation panels 501-504 may be made of any suitable insulating material, for example a moldable foam insulation such as polyisocyanurate, polystyrene, polyurethane, or another kind of insulation. While four different insulation panels are shown, the insulation may be formed by more or fewer different segments. For example, front insulation panel 503 may be molded monolithically with bottom insulation panel 504. Other combinations are possible as well. (Insulation of the top of drawer 107 will be discussed below.)

Compartments 505 reside in the chamber formed by insulation panels 501-504. Compartments 505 may be defined by a divider made of any suitable material and formed by any suitable process, but may conveniently be molded from a polymer such as polycarbonate, ABS, another polymer, or a blend of polymers. In other embodiments, compartments 505 may be made from a metal such as stainless steel, aluminum, or another suitable metal. Compartments 505 may be integrally formed from a single piece of material, or may be separate from each other and placed into drawer 107 in any workable combination. Compartments 505 are covered by lids 308.

An evaporator 506 is disposed between compartments 505 and bottom insulation panel 504. Evaporator 506 is part of a refrigeration system integrated into drawer 107. Evaporator 506 may be, for example, a roll-bonded evaporator, formed by roll bonding two sheets of metal with a pattern of channels marked on them, and then inflating the channels to form a network or serpentine passage through the channels for the flow of refrigerant. Evaporator 506 absorbs thermal energy from the interior of drawer 107 by virtue of its low temperature, and carries it outside the interior of drawer 107, cooling the interior of drawer 107, including compartments 505.

Other parts of the refrigeration system include a compressor 507 and a condenser 508, along with an expansion valve (not shown). These parts form the components implementing a traditional refrigeration cycle. The refrigeration system preferably uses a refrigerant that does not contain chlorinated fluorocarbons (CFCs).

A fan 509 draws air through condenser 508 to cool the refrigerant after the refrigerant has been heated in evaporator 506 and compressed in compressor 507, to expel thermal energy outside of cabinet 100.

A glycol bottle 510 may be provided, and may fit in a special compartment 511 in the interior of drawer 107, with its own lid 512. Preferably, a temperature sensor is submerged in glycol within bottle 510, and connected to controller 103 so that controller 103 can monitor the temperature of the interior of drawer 107. The glycol serves to buffer the sensor from rapid fluctuations in apparent temperature that may be caused by, for example, openings of drawer 107 from cabinet 100. In some embodiments, controller 103 may signal the refrigeration system to cycle on and off based on the temperature as sensed by the temperature sensor.

Figure 7:
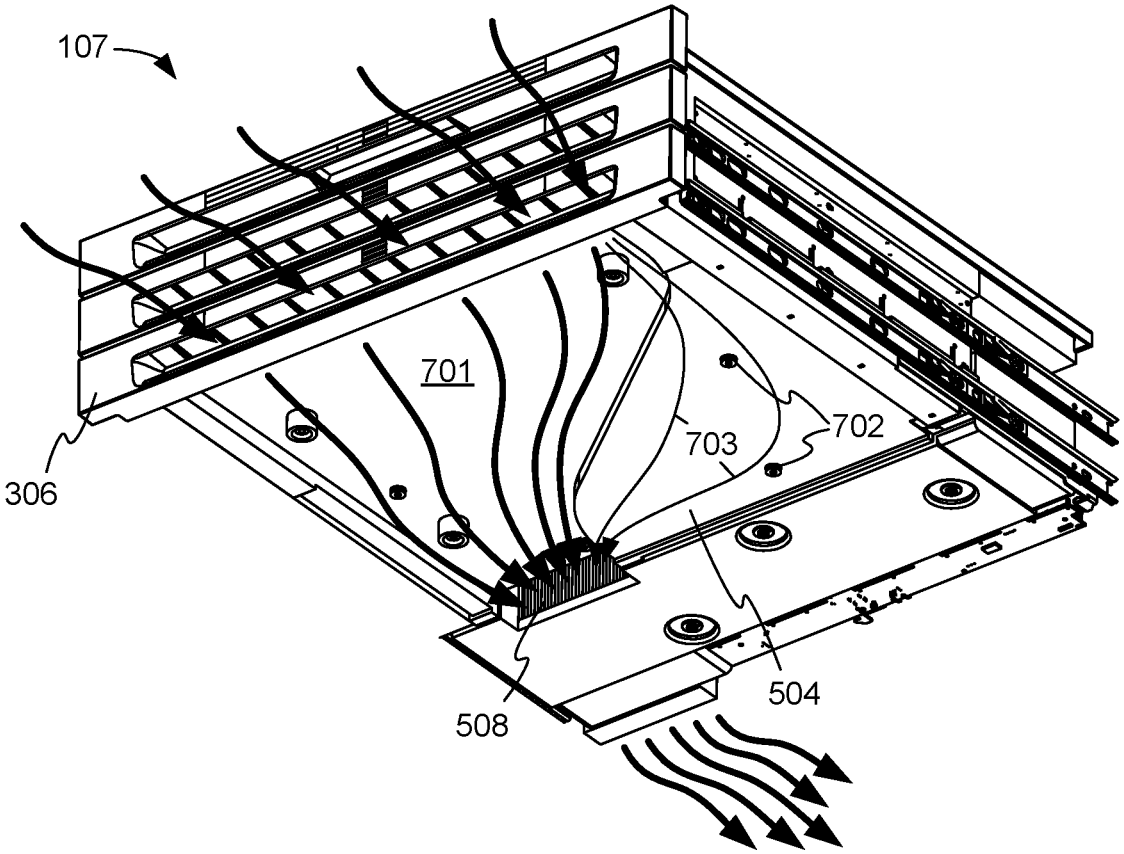
FIG. 7 shows an underside oblique view of the drawer of FIG. 3, with its bottom cover removed.

FIG. 7 shows an underside oblique view of drawer 107, with its bottom cover removed, exposing bottom insulation panel 504. In this example embodiment, bottom insulation panel 504 has a funnel-shaped air flow path 701 molded into it. When drawer 107 is fully assembled, a bottom panel (not shown) forms the remaining side of air flow path 701. Air may enter air flow path 701 through an opening in the front side of drawer 107, for example an opening hidden in one of fascia pieces 306. The funnel shape of air flow path 701 directs the air to condenser 508 under the impetus of fan 509 (not visible in FIG. 7). After flowing through condenser 508, the air is exhausted to the environment at the back of cabinet 100.

This air flow arrangement serves multiple purposes. First, it provides cooling air to condenser 508, for cooling the refrigerant in the refrigeration system as part of the refrigeration cycle. The air is exhausted from the back of cabinet 100 rather than the front, which may be preferable for user comfort. And second, the air flow under insulation panel 504 can evaporate and exhaust any condensation that may form under insulation panel 504. Standoffs 702 may hold the back cover away from insulation panel 504, permitting at least a small amount of air 703 to flow over substantially the entire underside of insulation panel 504.

Figure 8:
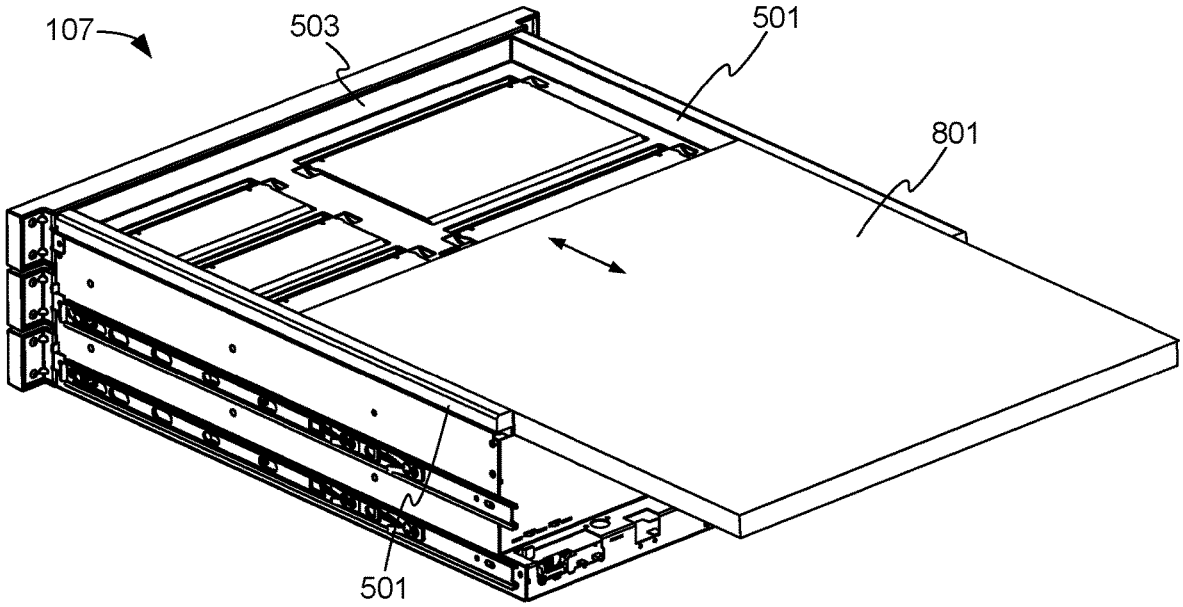
FIG. 8 shows an upper rear oblique view of the drawer of FIG. 3, in accordance with embodiments of the invention.

FIG. 8 shows an upper rear oblique view of drawer 107, in accordance with embodiments of the invention. The view of FIG. 8 is similar to the view of FIG. 4, with the addition of a top insulation panel 801. Top insulation panel 801 may be shaped and sized to slide into an open recess left in the top of drawer 107 by the other components. For example, top insulation panel 801 may fit between the tops of side insulation panels 501 and may contact front insulation panel 503 when top insulation panel 801 if fully installed on drawer 107. Top insulation panel 801 may also contact back insulation panel 502 (not visible in FIG. 8) so that the interior of drawer 107 is essentially encased in insulation. Top insulation panel 108 is preferably mounted in cabinet 100 such that top insulation panel 801 remains inside cabinet 100 when drawer 107 is opened, so as not to interfere with access to the compartments in drawer 107. When drawer 107 is closed, top insulation panel 801 automatically covers drawer 107 again.

In other embodiments, top insulation panel 801 may travel with drawer 107 when drawer 107 is opened, and the user may simply slide top insulation panel 801 back toward cabinet 100 to gain access to the interior of drawer 107.

Top insulation panel 801 may be made of any suitable material, for example a material similar to the material of the other insulation panels, or a different material.

Figure 9:
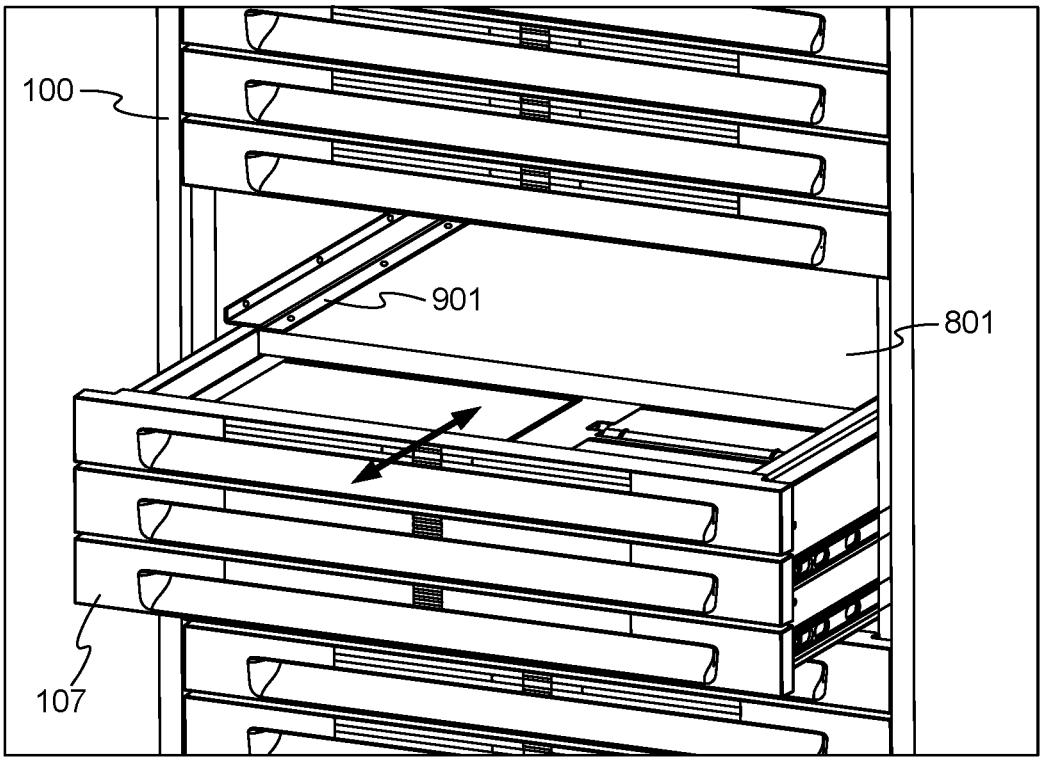
FIG. 9 illustrates a partial view of the cabinet of FIG. 1, with an insulation panel in place according to embodiments of the invention.

FIG. 9 illustrates a partial view of cabinet 100 with insulation panel 801 in place above drawer 107. Drawers immediately above drawer 107 have been removed. As drawer 107 is opened and closed, insulation panel 801 remains in place, so that the interior of drawer 107 is accessible when drawer 107 is open, but drawer 107 is fully insulated when closed. In the example of FIG. 9, a bracket 901 holds insulation panel 801 in place within cabinet 100, and drawer 107 slides beneath insulation panel 801. However, other arrangements are possible.

Figure 10:
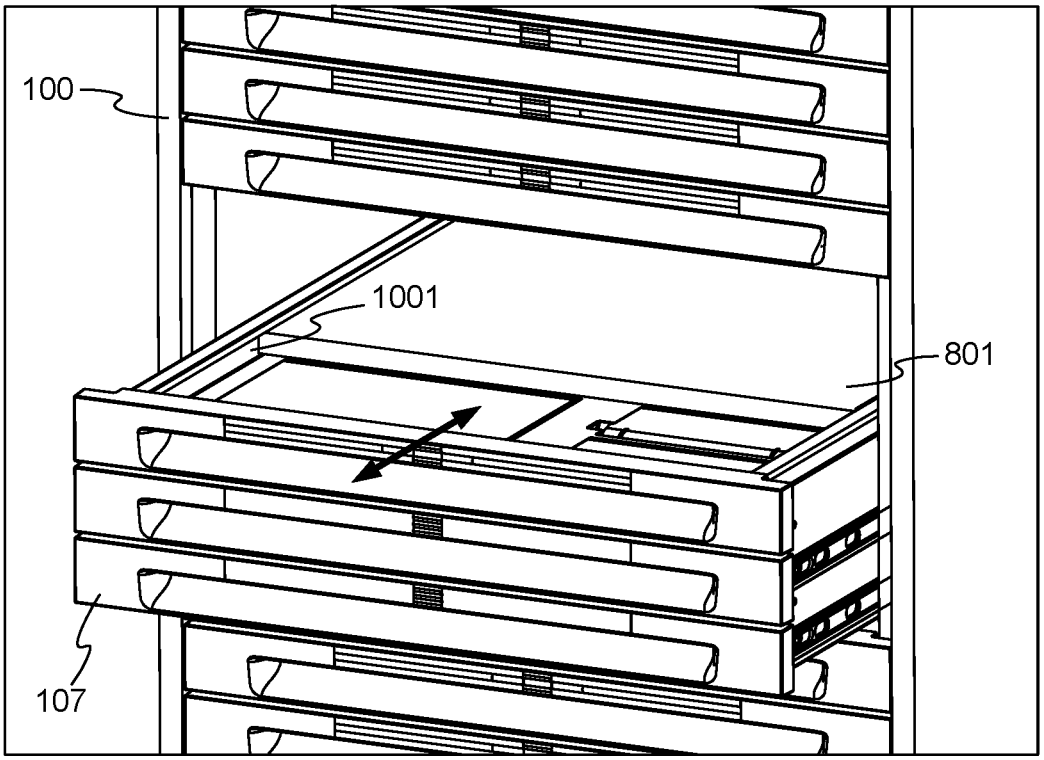
FIG. 10 illustrates another embodiment of the cabinet of FIG. 1 with an insulation panel in place according to embodiments of the invention.

For example, FIG. 10 illustrates another embodiment, in which insulation panel 801 is slidingly captured within a groove 1001 in the side of drawer 107. Insulation panel 801 may be attached to a back wall of cabinet 100 so that insulation panel 801 does not slide out of cabinet 100 when drawer 107 is opened. In other embodiments, insulation panel 801 may simply be pushed back by the user to expose the interior of drawer 107 when drawer 107 is open.

Figure 11:
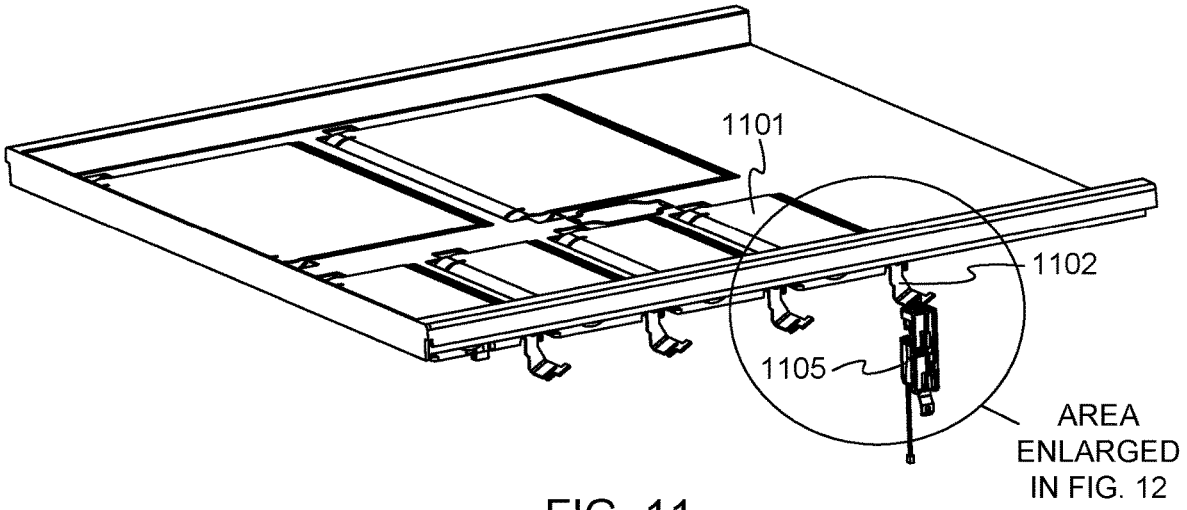
FIG. 11 shows an upper oblique view of the top of the drawer of FIG. 3 with many components removed, to reveal a mechanism for achieving computer control of access to the individual storage bins within the drawer, in accordance with embodiments of the invention.
Figure 12:
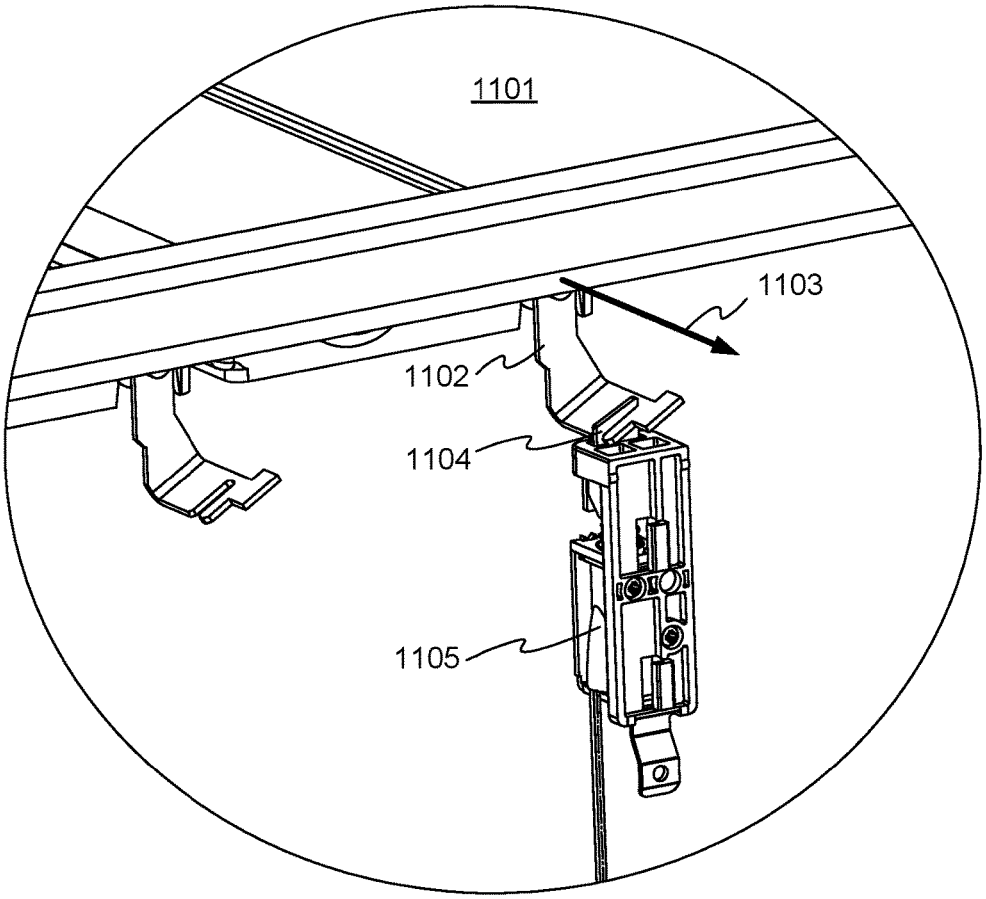
FIG. 12 shows a portion of FIG. 11 in more detail.

Because the interior of drawer 107 is at a cold temperature, it may be desirable to keep electronic and electromechanical components out of the interior of drawer 107 to the extent possible, to avoid potential cold-induced problems. For example, FIG. 11 shows an upper oblique view of the top of drawer 107 with many components removed, to reveal a mechanism for achieving computer control of access to the individual storage bins in drawer 107. FIG. 12 shows a portion of FIG. 11 in more detail. In this example, lid 1101 includes a lever 1102 configured to rotate with lid 1101 about an axis 1103. In the position shown, a blade 1104 connected to an armature of a solenoid 1105 blocks rotation of lever 1102, and therefore of lid 1101. In this condition, the bin under lid 1101 is locked.

Figure 13:
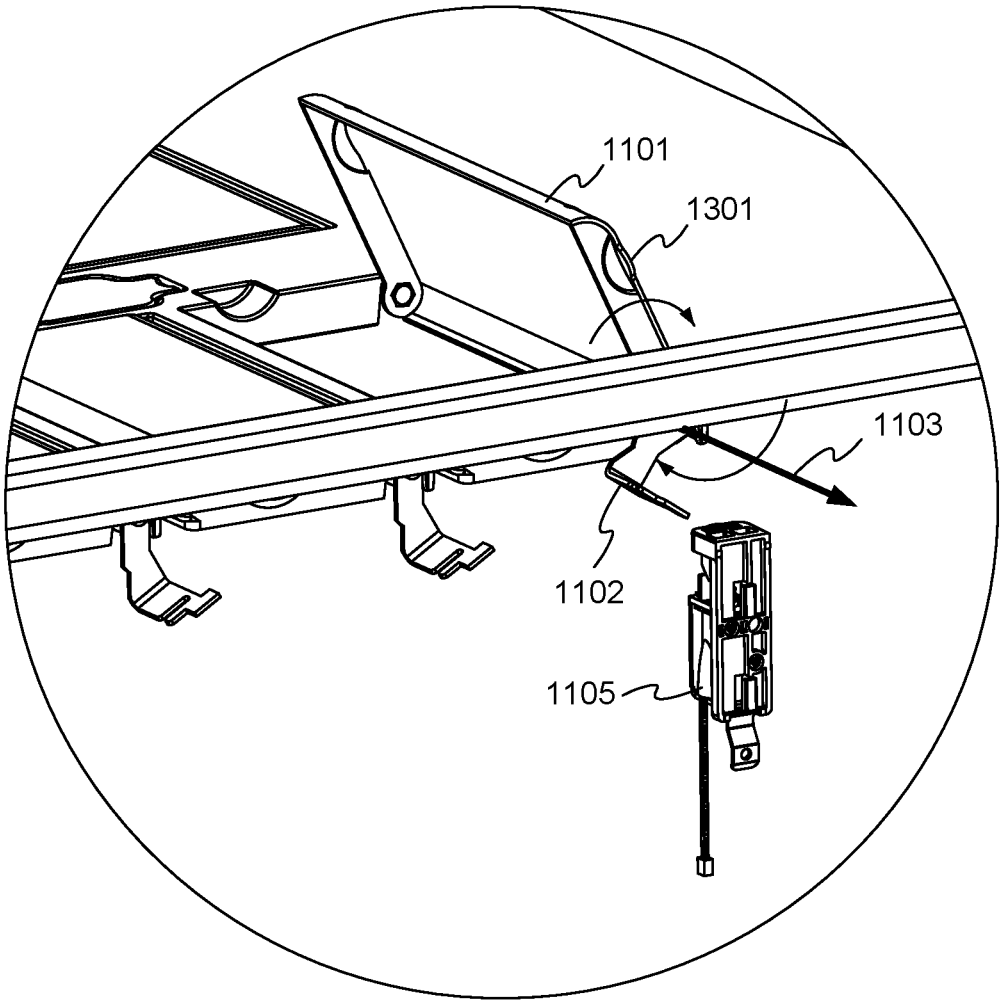
FIG. 13 shows a lid of a compartment of the drawer of FIG. 3 in an open position, in accordance with embodiments of the invention.

However, when solenoid 1105 is energized, for example under control of controller 103, blade 1104 is withdrawn, allowing lever 1102 and lid 1101 to rotate to an open position. FIG. 13 shows lid 1101 in the open position. For example, the user may lift lid 1101 using finger pull 1301 once solenoid 1105 has released the lid. Once the user is finished with access to the bin under lid 1101, the user can simply push lid 1101 back to the closed position. Lever 1102 interacts with the angled top of blade 1104 to deflect blade 1104 downward to allow lever 1102 to pass. Once lever 1102 has passed blade 1104, blade 1104 can return to its normal upward position under the action of a spring (not visible in FIG. 13), locking lid 1101 in the closed position.

Solenoids 1105 are but one example of a type of actuator that may be used to control access to the compartments in drawer 107, and other kinds of actuators may be used, for example, magnetic actuators, motors with appropriate linkages, or other kinds of actuators.

Figure 14:
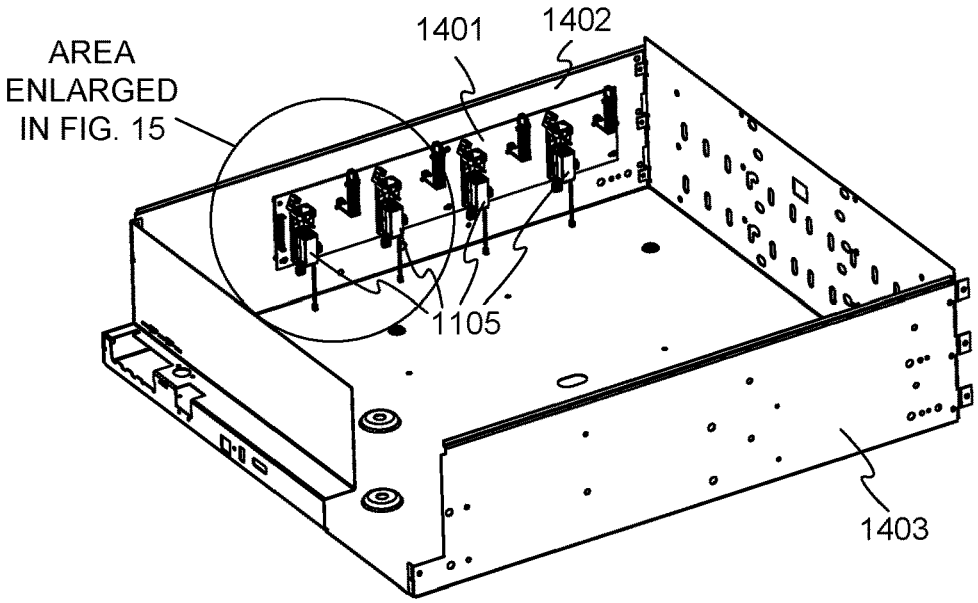
FIG. 14 shows an upper rear oblique view of the drawer of FIG. 3, with several components removed, in accordance with embodiments of the invention.
Figure 15:
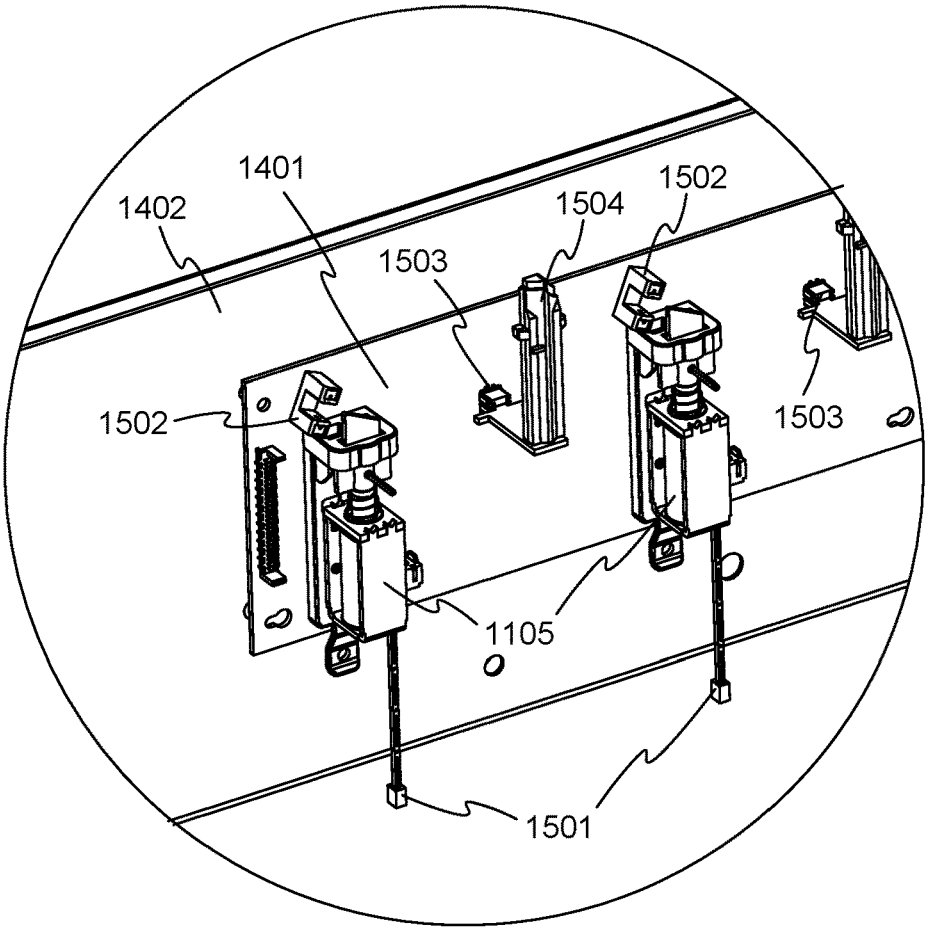
FIG. 15 shows an enlarged view of a portion of FIG. 14.

The architecture of drawer 107 may at least partially protect solenoid 1105 and its driving electronics from the cold environment within drawer 107. FIG. 14 shows an upper rear oblique view of drawer 107, with several components removed, and FIG. 15 shows an enlarged view of a portion of FIG. 14. A printed circuit board 1401 is mounted to side 1402 of drawer 107. A number of solenoids 1105 are mounted to circuit board 1401, and are connected via connectors 1501 to other circuitry (not shown) and eventually to controller 103. Similar components may be attached to the inner face of the other side 1403 of drawer 107 as well, but are not visible in FIG. 14.

A number of sensors 1502 may be provided, for providing positive feedback when the lever 1102 of one of lids 308 is in the closed position. Light emitting diodes (LEDs) 1503 may be present and also controllable by controller 103, for visually indicating the status of particular compartments through light pipes 1504, which extend to the top of drawer 107.

Figure 16:
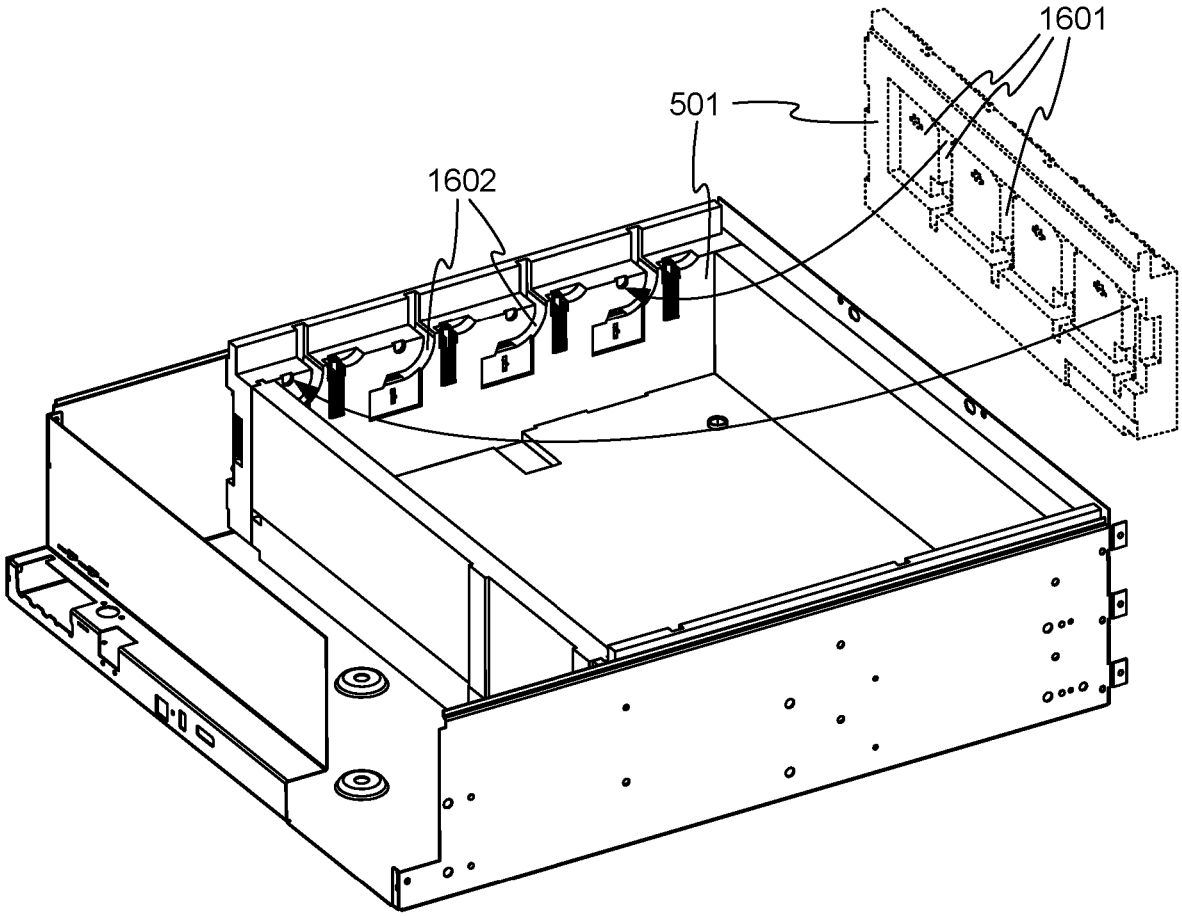
FIG. 16 illustrates the installation of an insulation panel in the drawer of FIG. 3, in accordance with embodiments of the invention.

With printed circuit board 1401 in place, including solenoids 1105, the insulation of drawer 107 can be put in place, as shown in FIG. 16. For example, side insulation panel 501 includes a number of recesses 1601 for accommodating printed circuit board 1401 and the components on it, including solenoids 1105. Once side insulation panel 501 is in place in drawer 107, printed circuit board 1401 and its associated components are positioned outside the refrigerated interior of drawer 107. Various slots 1602 in insulation panel 501 provide access to components on circuit board 1401, and are as small as possible so as to not compromise the insulating effect of insulation panel 501 more than necessary.

Figure 17:
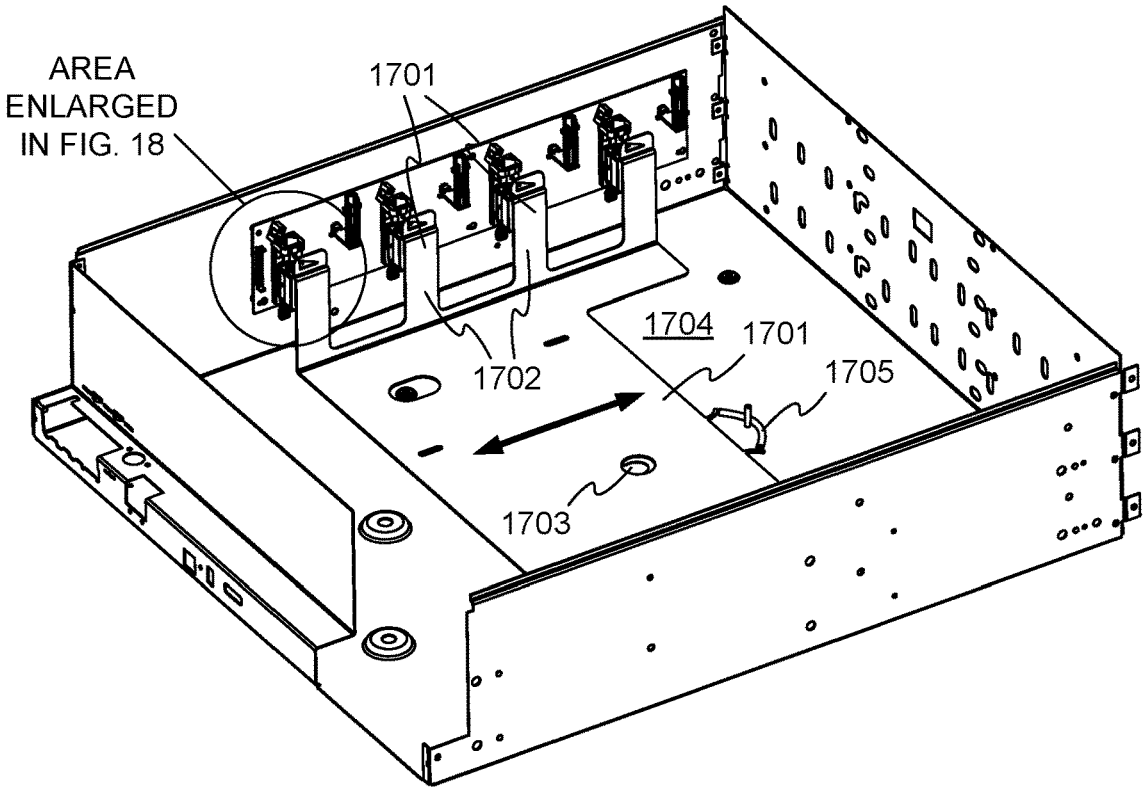
FIG. 17 illustrates an override mechanism in accordance with embodiments of the invention.
Figure 18:
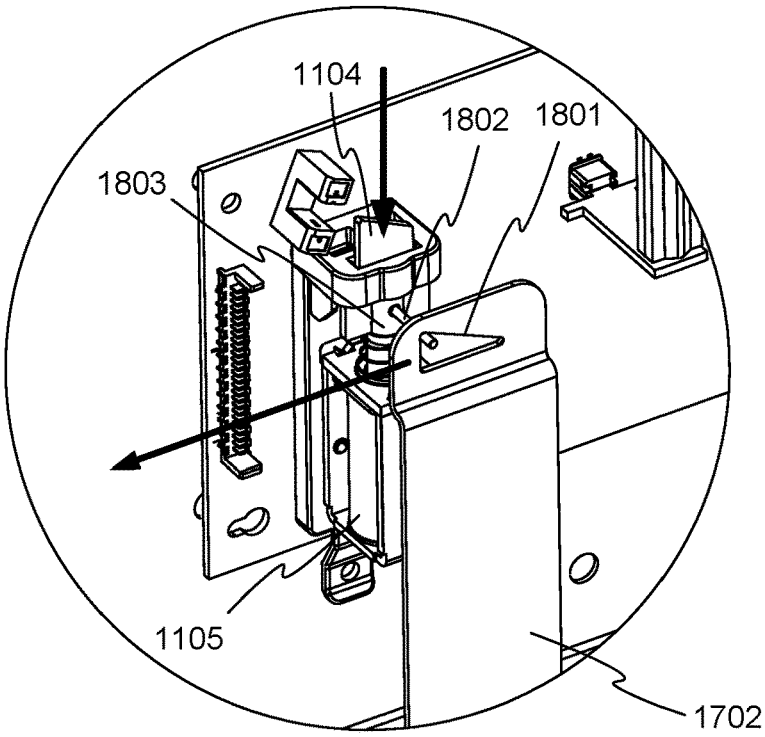
FIG. 18 shows a portion of FIG. 17 in more detail.

In some embodiments, a manual override mechanism is provided, for unlocking the compartments in drawer 107 manually, without reliance on controller 103. This capability may be useful, for example during a power outage or other occasion when controller 103 is not able to open the compartments. FIGS. 17 and 18 illustrate one example override mechanism. An override plate 1701 fits under the insulation (not shown) at the bottom of drawer 107, and includes risers 1702 at the sides of drawer 107 corresponding to solenoids 1105. Risers 1702 may extend inside the temperature-controlled interior of drawer 107, passing though slits in the lower insulation panel. Override plate 1701 may be accessible from the bottom of drawer 107. For example, a user may insert a finger through hole 1703 in bottom plate 1704 of drawer 107, to actuate override plate 1701 against a spring 1705.

As is best visible in FIG. 18, when override plate 1701 is actuated, a ramp feature 1801 in each riser 1702 interacts with a pin 1802 on the armature 1803 of the corresponding solenoid 1105, drawing armature 1803 and blade 1104 downward. With blade 1104 withdrawn, the corresponding lid is unlocked, as is described above and shown in FIG. 13.

In another embodiment, a dispensing device uses a thermoelectric refrigeration system, rather than a refrigeration system having a compressor and condenser as described above.

Figure 19:
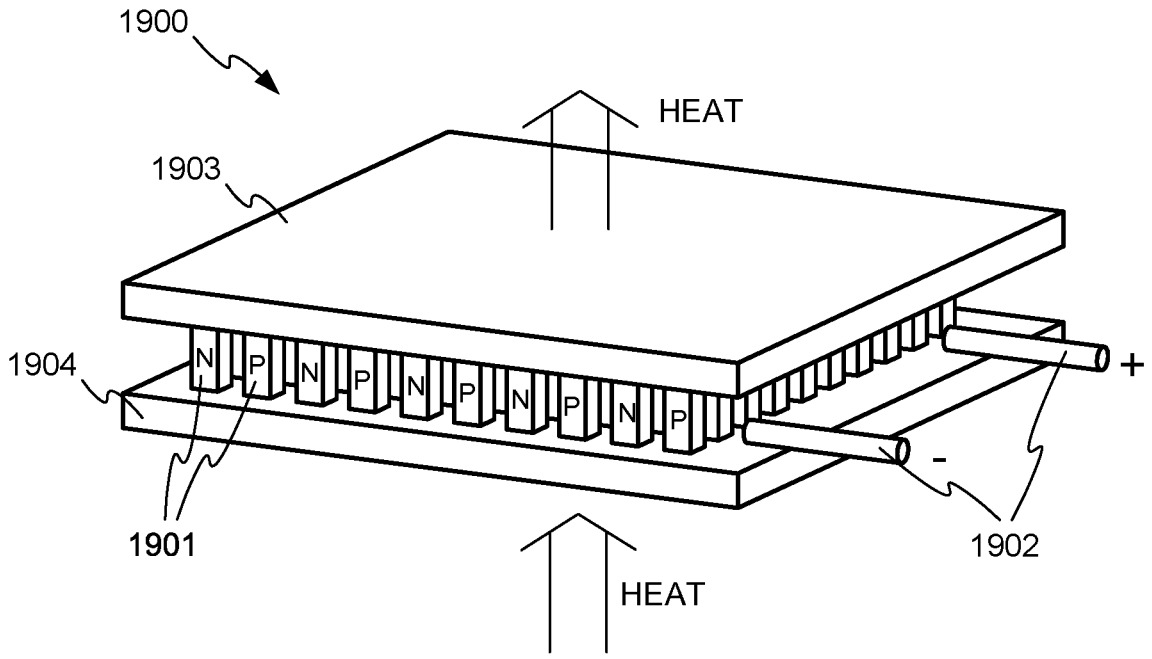
FIG. 19 illustrates a basic thermoelectric module, in accordance with embodiments of the invention.

FIG. 19 illustrates a basic thermoelectric module 1900. A number of columns 1901 are made of alternating N- and P-type semiconductors. Columns 1901 are electrically connected in series between electrodes 1902, and are thermally in parallel between hot side plate 1903 and cold side plate 1904. When a DC voltage is imposed on electrodes 1902, heat is transported from cold side plate 1904 to hot side plate 1903, cooling cold side plate 1904 and warming hot side plate 1903. Plates 1903 and 1904 are made of a thermally conductive material. Module 1900, alone or in combination with other similar modules, can be used to cool or heat spaces. Thermoelectric cooling has the advantage that it requires no moving parts. A thermoelectric module such as module 1900 may be able to transport up to about 15-30 watts or more of heat for every square inch of module, measured at a zero temperature differential.

Figure 20:
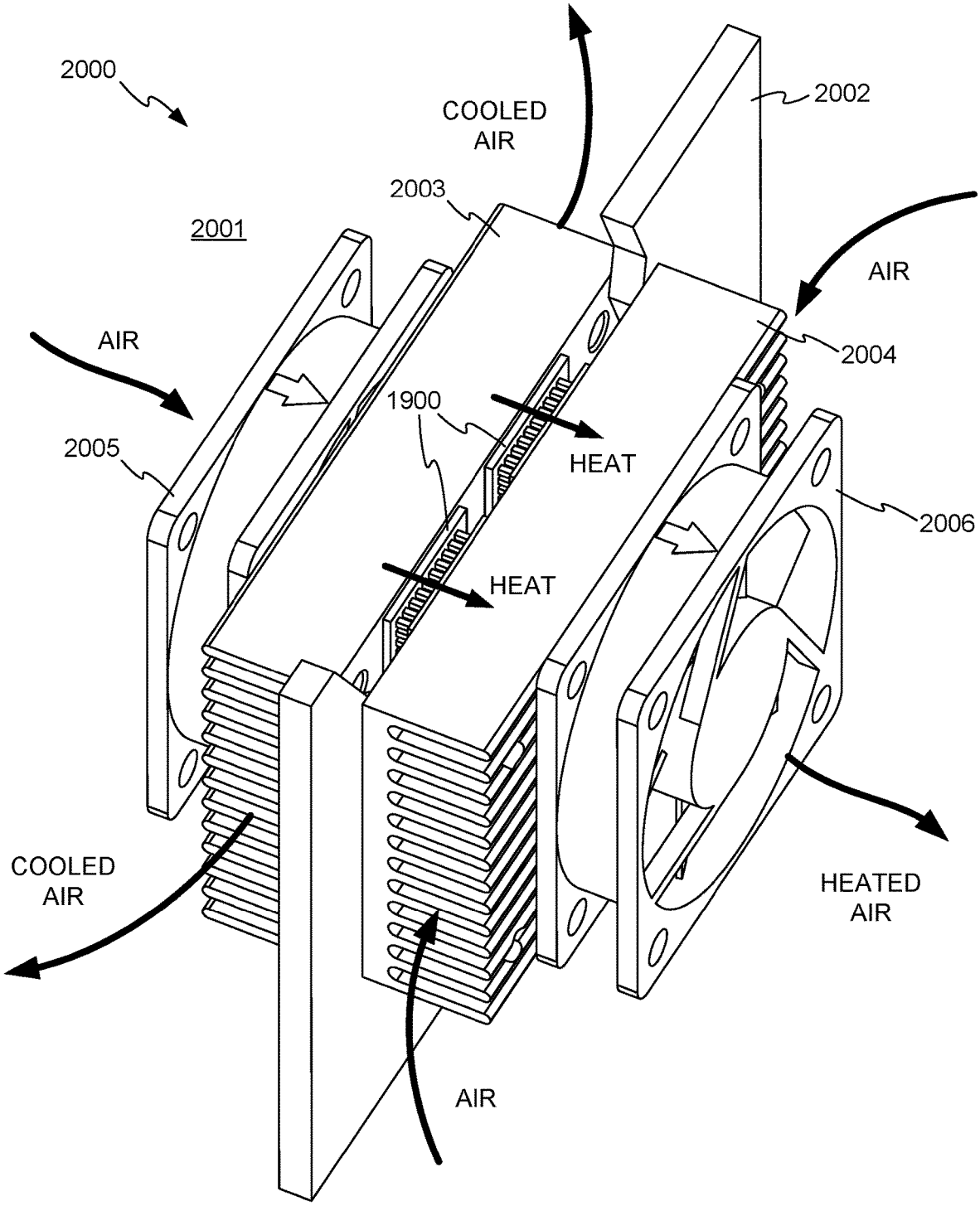
FIG. 20 illustrates a cooling unit including the thermoelectric module of FIG. 19, in accordance with embodiments of the invention.

FIG. 20 illustrates a cooling unit 2000 in accordance with embodiments of the invention, for cooling a space 2001 on one side of panel 2002. A number of thermoelectric modules 1900 are sandwiched in thermal contact between a finned cold side heat sink 2003 and a finned hot side heat sink 2004. Thermoelectric modules 1900 are positioned and energized to transport heat from cold side heat sink 2003 to hot side heat sink 2004, thereby cooling cold side heat sink 2003. A cold side fan 2005 is configured to force air from cooled space 2001 into the fins of cold side heat sink 2003. The air is cooled by its contact with cold side heat sink 2003 (which is in turn cooled by thermoelectric modules 1900), and exhausts through the fins of cold side heat sink 2003 back into cooled space 2001. Thus the air in cooled space 2001 is further cooled.

A hot side fan 2006 is configured to draw air from the fins of hot side heat sink 2004. The air is heated by its contact with hot side heat sink 2004, and is exhausted through the fins of hot side heat sink 2004 into the space on the hot side of the system.

It will be recognized that the direction of air flow through either or both of fans 2005 and 2006 could be reversed from the orientation shown in FIG. 20.

Figure 21:
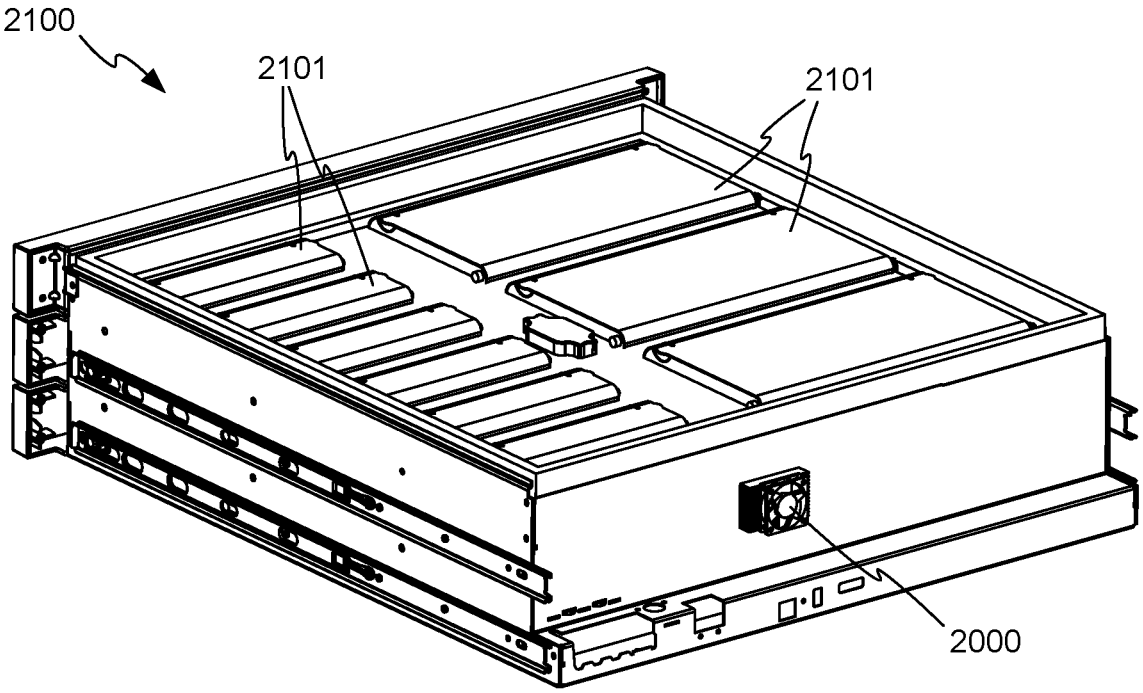
FIG. 21 illustrates a drawer using the thermoelectric cooling unit of FIG. 20 to cool the interior of the drawer, in accordance with embodiments of the invention.

FIG. 21 illustrates a drawer 2100 using thermoelectric cooling unit 2000 to cool the interior of the drawer, in accordance with embodiments of the invention. Drawer 2100 is similar in many ways to drawer 107 described above, in that drawer 2100 is configured to be inserted into a dispensing cabinet such as dispensing cabinet 100. Drawer 2100 has a number of compartments for storing items, and the compartments are covered by individually-lockable lids 2101. Any suitable number of compartments may be provided, depending on the size of drawer 2100 and the sizes of the items to be stored in drawer 2100. The compartments may be of different sizes, or may all be the same size.

Figure 22:
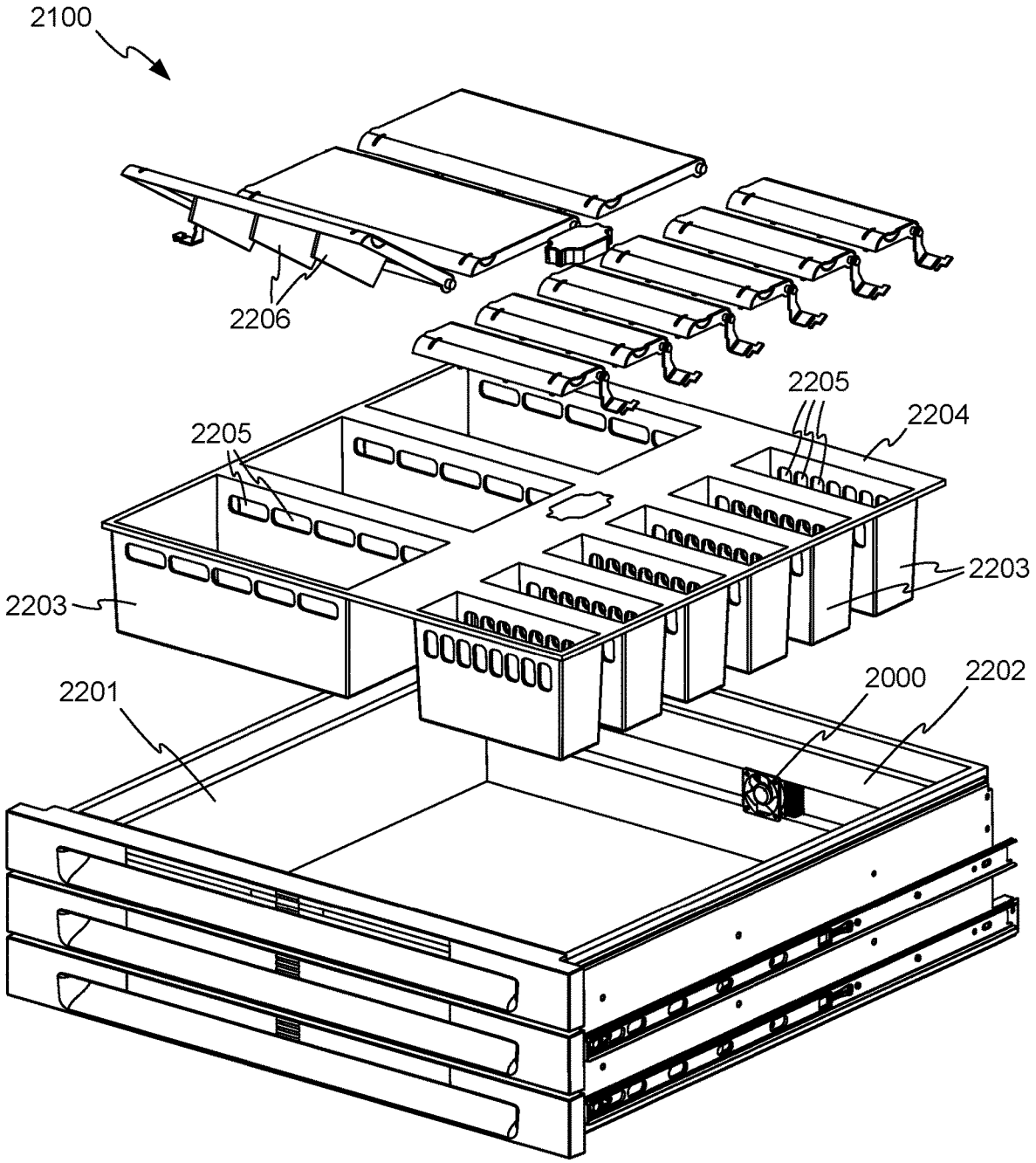
FIG. 22 illustrates an exploded view of the drawer of FIG. 21

FIG. 22 illustrates an exploded view of drawer 2100. The interior of drawer 2100 is preferably lined with insulation 2201, to reduce the amount of energy required to cool the interior space. Thermoelectric cooling unit 2000 is mounted in any convenient wall of drawer 2100, in this example back wall 2202. Thermoelectric cooling unit 2000 draws its power from the electronics of drawer 2100 (not shown) and ultimately from cabinet 100. Thermoelectric cooling unit 2000 is positioned to transport heat from the interior of drawer 2100 to the space outside of drawer 2100. The fans of thermoelectric cooling unit 2000 server to circulate the air within drawer 2100 to cool the interior of drawer 2100, and to provide airflow to the outer heat sink of thermoelectric cooling unit 2000 to exhaust heat outside of drawer 2100.

Figure 29:
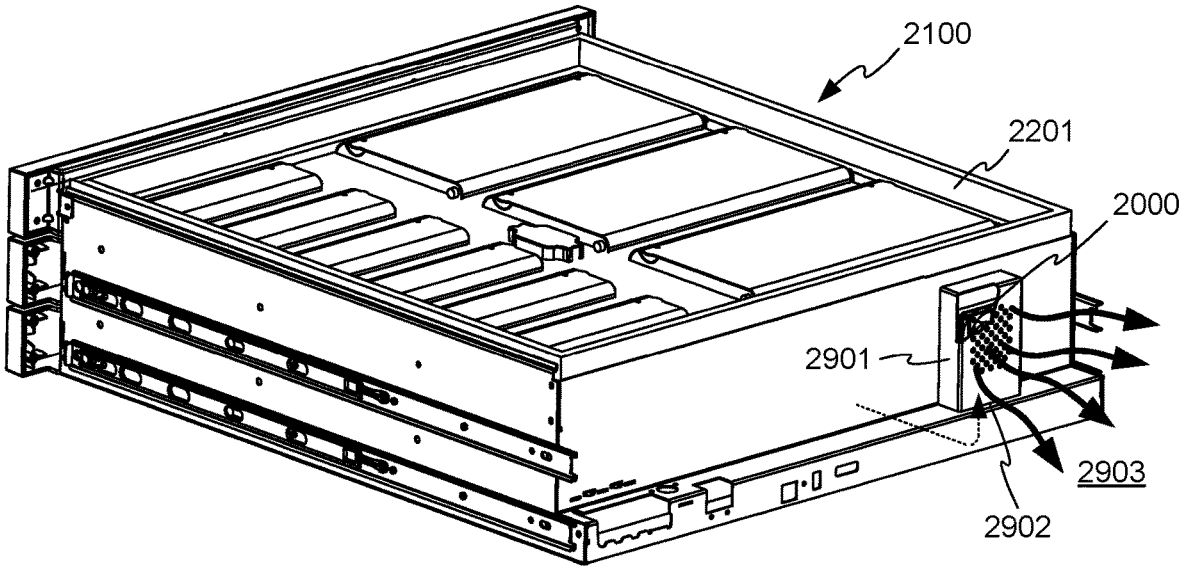
FIG. 29 illustrates a refrigerated drawer in in accordance with other embodiments of the invention.
Figure 30:
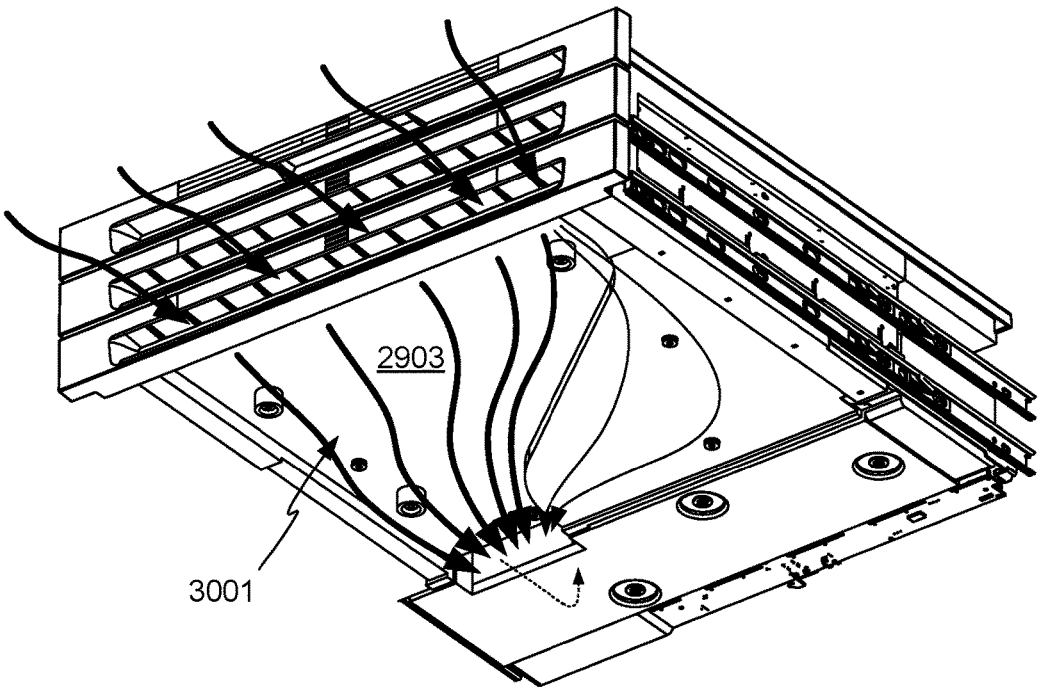
FIG. 30 illustrates a partial underside view of the drawer of FIG. 29.

In some embodiments, the fan of cooling unit 2000 outside of drawer 2100 may be positioned, ducted, or otherwise arranged to also provide airflow under or around the insulated space of drawer 2100. For example, the fan, in addition to providing air flow over the heat sink of thermoelectric cooling unit 2000, may provide airflow under the insulated space of drawer 2100 similar to the airflow shown in FIG. 7, to help prevent condensation at the bottom of drawer 2100. FIG. 29 and FIG. 30 illustrate an embodiment in which cooling unit 2000 has been enclosed in a shroud 2901, which is connected at its bottom end 2902 to a plenum 3001 under insulation 2201. The outer fan of cooling unit 2000 generates airflow 2903 out of shroud 2901. FIG. 30 shows an underside view of drawer 2100 with its bottom cover removed. As is visible in FIGS. 29 and 30, airflow 2903 passes under insulation 2201 before being ducted upward to shroud 2901 and out to the surrounding environment.

Any other suitable arrangement may be used for creating airflow under or around the insulated space of drawer 2100. For example, in other embodiments, two separate fans could be provided—one for creating airflow under or around the insulated space, and one for exhausting heat from cooling unit 2000.

Referring again to FIG. 22, compartments 2203 are separately enclosed. In example drawer 2100, compartments 2203 are molded into a unit 2204, but any suitable way of defining the individual compartment spaces may be used. The walls of compartments 2203 may be perforated by openings such as openings 2205, so that air can circulate within drawer 2100, passing through the walls and compartments. The undersides of lids 2101 may include descending ribs 2206 that protrude into the compartments when lids 2101 are closed. Ribs 2206 thus prevent complete filling of compartments 2203. The top portions of the compartments remain substantially open, permitting airflow throughout drawer 2100.

As in other embodiments, a temperature sensor within drawer 2100 preferably provides a signal to a controller such as controller 103, indicating the temperature with drawer 2100. The temperature sensor may be submerged in a glycol bottle or other buffer if desired. Controller 103 can cycle the power to thermoelectric cooling unit 2000 as needed to maintain an essentially constant temperature within drawer 2100.

Although a drawer embodying the invention may be used for any purpose, it may be especially suitable for storing vaccines. U.S. federal guidelines specify that vaccines should be stored at temperatures of 2° C. to 8° C.

The arrangement of FIGS. 21 and 22 may have several beneficial aspects. For example, the thermoelectric cooling system is simple to install and operate, has no moving parts other than fans, and does not contain any liquids that could leak and cause damage in the event of a failure. In addition, thermoelectric cooling unit 2000 may be smaller than the compressor-based system described above, and therefore a thermoelectrically-cooled drawer may have a larger storage capacity than a comparably-sized drawer cooled using a compressor-based system.

Figure 23:
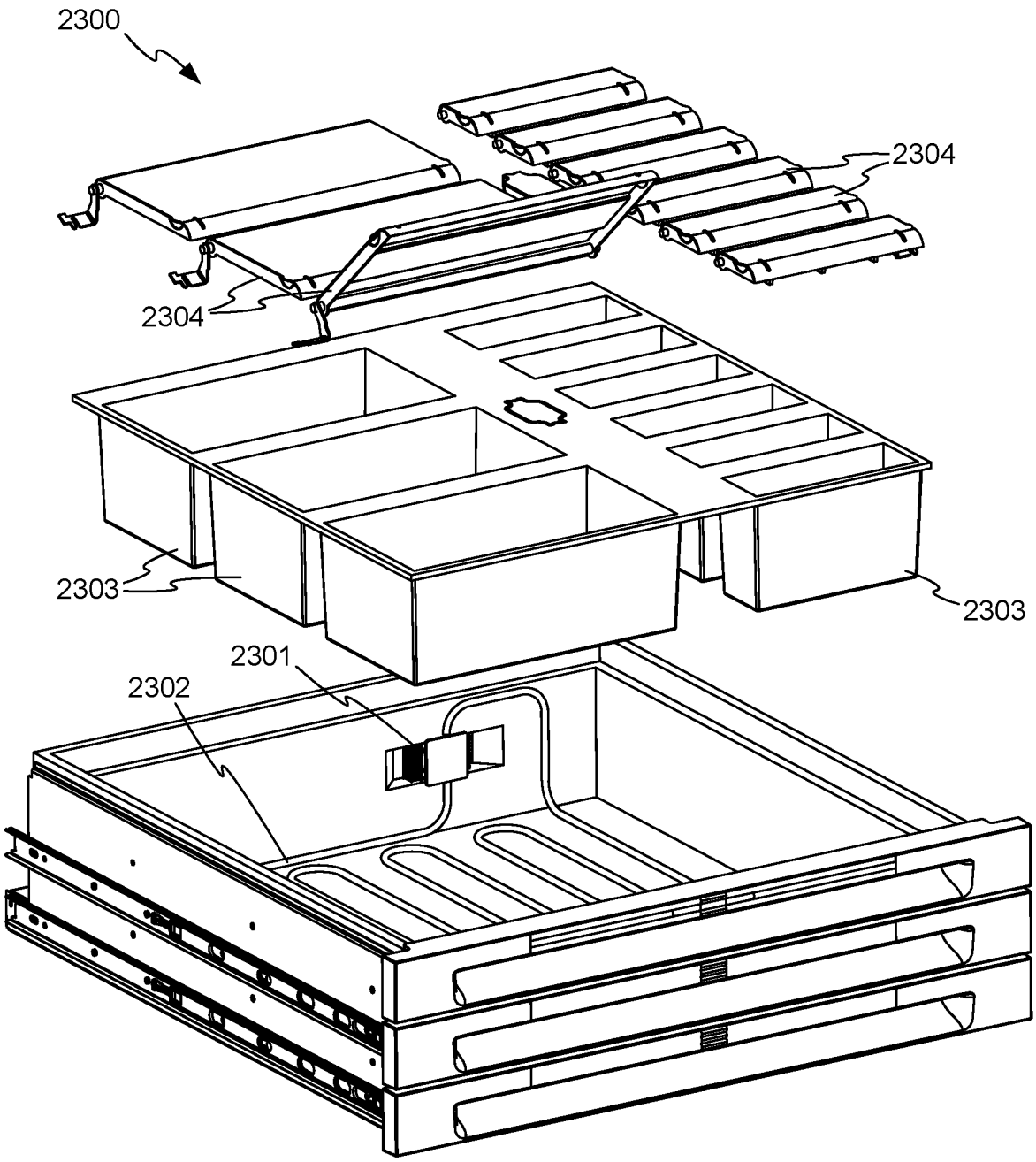
FIG. 23 illustrates an exploded view of a drawer having a cooling system in accordance with other embodiments.

FIG. 23 illustrates an exploded view of a drawer 2300 having a cooling system in accordance with other embodiments. Drawer 2300 includes a thermoelectric cooling unit 2301 similar to thermoelectric cooling unit 2000, but possibly without a fan inside drawer 2300. Rather than cooling the drawer interior with circulating cooled air, drawer 2300 includes a cooling loop 2302, filled with a heat transfer fluid. For example, cooling loop 2302 may be a closed loop of copper or other tubing, filled with carbon dioxide ($CO_2$) at a pressure such that the boiling point of the $CO_2$ is at approximately the desired temperature of the inside of drawer 2300, or slightly below. In some embodiments, the pressure of $CO_2$ within cooling loop 2302 may be about 40 bar (approximately 40 atmospheres), such that the boiling point of the $CO_2$ is about 5° C. Cooling loop 2302 may thus form a passive heat pipe cooler.

As the $CO_2$ is cooled in thermoelectric cooling unit 2301 (via an appropriate heat exchanger), the $CO_2$ condenses and falls by gravity to the loop placed in the floor of drawer 2300. As the $CO_2$ circulates through drawer 2300, it absorbs heat from the interior of drawer 2300 and boils, cooling the interior of drawer 2300. The gaseous $CO_2$ rises again toward thermoelectric cooling unit 2301, where it is cooled again, continuing the cycle. As in other embodiments, a temperature sensor within drawer 2300 may provide a signal indicating the temperature within drawer 2300, so that a controller can cycle thermoelectric cooling unit 2301 on and off to maintain the desired temperature.

While slightly more complex than the air cooling system of drawer 2100 described above, the system of drawer 2300 may have certain advantages. For example, because it does not rely on the circulation of air throughout drawer 2300, compartments 2303 may not need to be perforated, and can be filled to a higher level, resulting in less dead space and a higher capacity for drawer 2300. Lids 2304 accordingly may not need ribs on their bottom sides to prevent complete filling of compartments 2303.

While other cooling fluids may be used, $CO_2$ or a similar substance may have the advantage that any leaks in the system will result in only the release of harmless gas into the atmosphere, and thus will not cause damage to the electronics of the storage cabinet or the materials stored in drawer 2300. Also, the placement of cooling loop 2302 in the bottom of drawer 2300 is but one example of a suitable loop placement. In other embodiments, cooling loop 2302 may include lines that pass between compartments 2303, along the sides of drawer 2300, or in another location or combination of locations. In some embodiments, cooling loop 2302 may be formed as a roll-bonded unit similar to evaporator 506 described above.

Regardless of how a drawer in accordance with embodiments of the invention is cooled, attention may be paid during design of the drawer to the possible presence of condensation at cold surfaces in or near the drawer. Condensation may tend to form on cold surfaces exposed to the air, and can be detrimental to electronics, electromechanical actuators, or other electrical or mechanical components. Preferably, the insulation surrounding the drawer interior is sufficiently insulative that its outside surface remains above the dew point of the surrounding atmosphere. In that case, any circuit boards, electromechanical actuators, or other electrical or mechanical components outside of the cooled space will remain substantially safe from condensation, so long as cold air leaks and other insulation gaps are minimized.

However, lids such as lids 2101 or 2304 must necessarily operate in the cooled space, and must be actuated automatically. In embodiments of the invention, measures are taken to position any electromechanical actuators outside of the cooled space, and to couple the actuators to the lids within the cooled space, preferably in a way that minimizes cold leakage.

Figure 24:
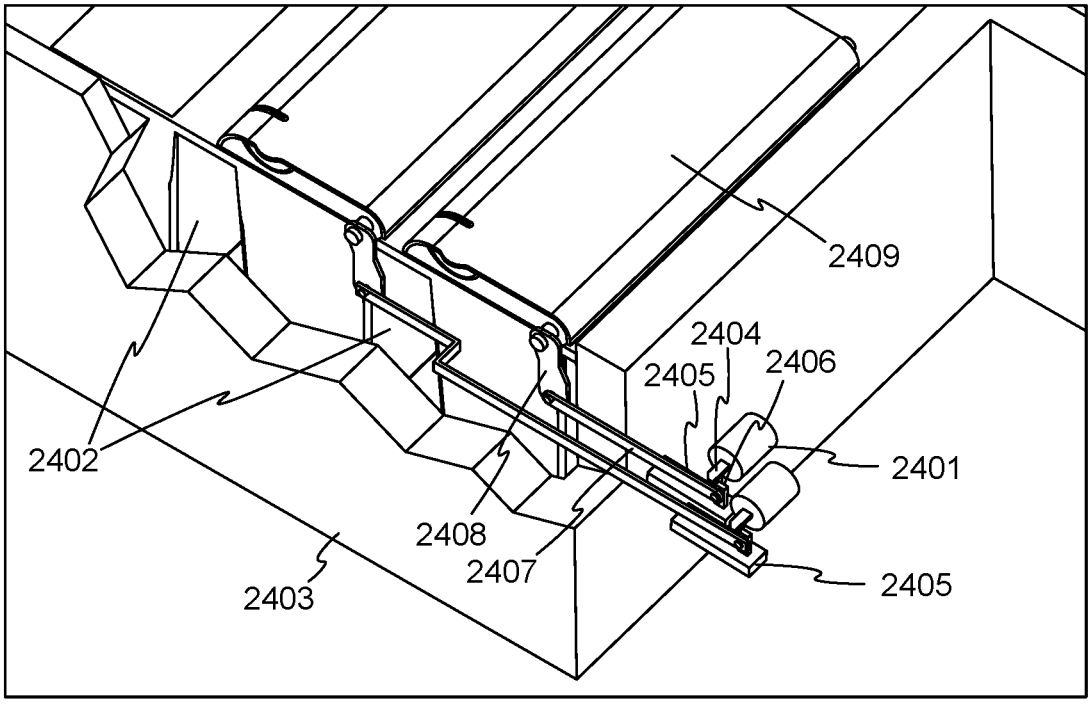
FIG. 24 illustrates one way of permitting opening of lids in a drawer, in accordance with embodiments of the invention.

FIG. 24 illustrates one way of permitting opening of lids in a drawer, in accordance with embodiments of the invention. Some support structure, wiring, and the like are omitted from the figures for clarity. In this example, actuators such as solenoid 2401 may be positioned outside of the cooled space 2402 defined by insulation 2403. Each solenoid 2401 has a plunger 2404 that is actuated electrically in response to signals from a controller, and is associated with a linear potentiometer 2405. In the "locked" position, plunger 2404 is extended from solenoid 2401, and prevents motion of slider 2406 of linear potentiometer 2405. A linkage 2407 connects slider 2406 to a lever 2408 on lid 2409. With slider 2406 blocked from motion, lid 2409 cannot be opened.

Figure 25:
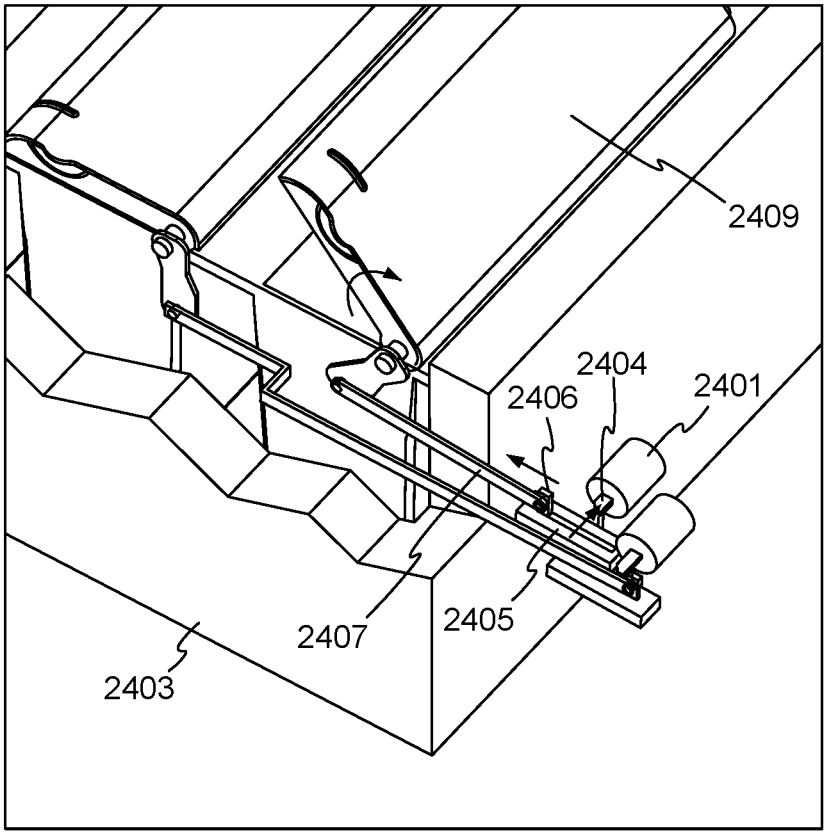
FIG. 25 shows the system of FIG. 24, with one lid opened.

FIG. 25 shows the system of FIG. 24, with lid 2409 opened. Plunger 2404 of solenoid 2401 has been retracted by the action of solenoid 2401, releasing slider 2406, so that it can be moved by linkage 2407 as the user lifts lid 2409. Signals from linear potentiometer 2405 may be sent to the controller, indicating that lid 2409 is open.

Each lid may be supplied with a similar solenoid-potentiometer-linkage arrangement. In this arrangement, solenoids 2401 and potentiometers 2405 remain outside the cooled space 2402, and are thus substantially protected from possible condensation. Only linkages 2407 penetrate insulation 2403, so that any openings in insulation 2403 are small and may not significantly affect the insulating effectiveness of insulation 2403.

Linear potentiometer 2405 may have the advantage that it can indicate the exact state of its associated lid, for example the degree to which the lid is open. In other embodiments, a simple optical interrupter or other simple binary indicator of whether the lid is open or closed may be used.

Figure 26:
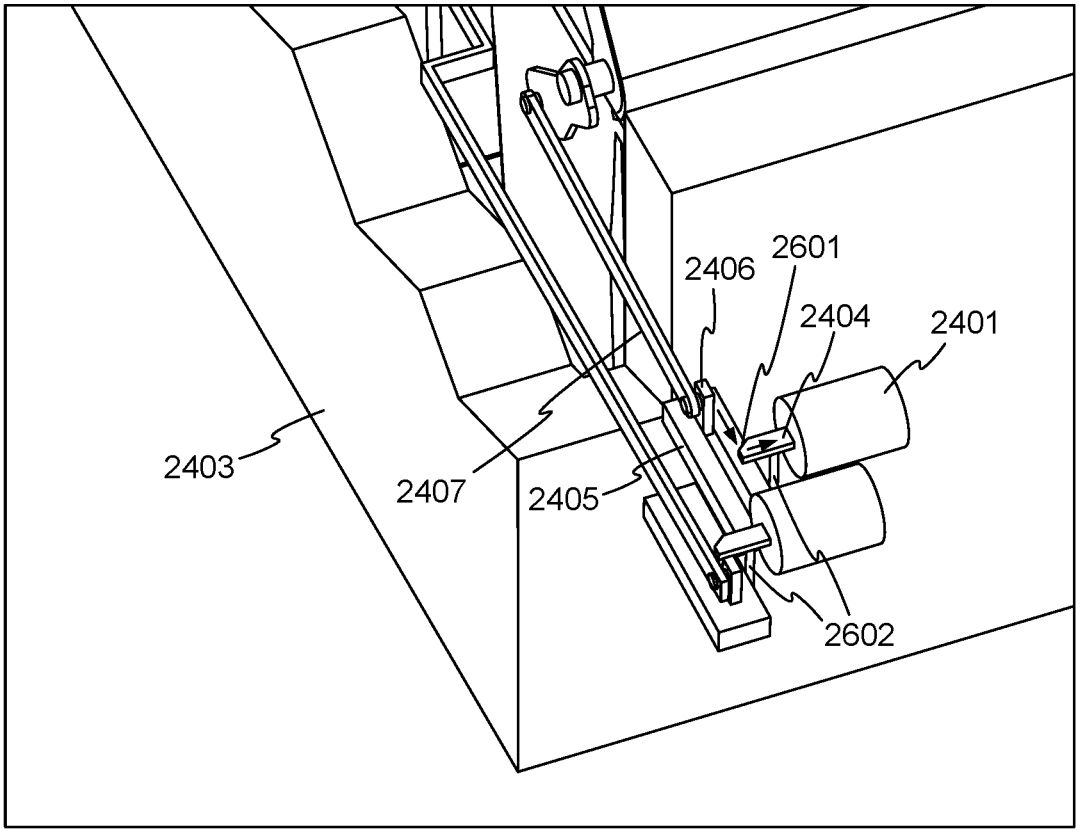
FIG. 26 shows the arrangement of FIG. 24 in further detail.

FIG. 26 shows the solenoid arrangement of FIG. 24 in further detail. A ramp 2601 on each plunger 2404 allows slider 2406 to push plunger 2404 back into solenoid 2401 as the corresponding lid is closed, latching the lid closed. In addition, a manual release lever 2602 may be provided on each solenoid, enabling a user to override the locking mechanism of the lids and open the lids manually in the event of a power outage or other failure. Manual release lever 2602 may preferably be accessible from outside of drawer 2300.

Figure 27:
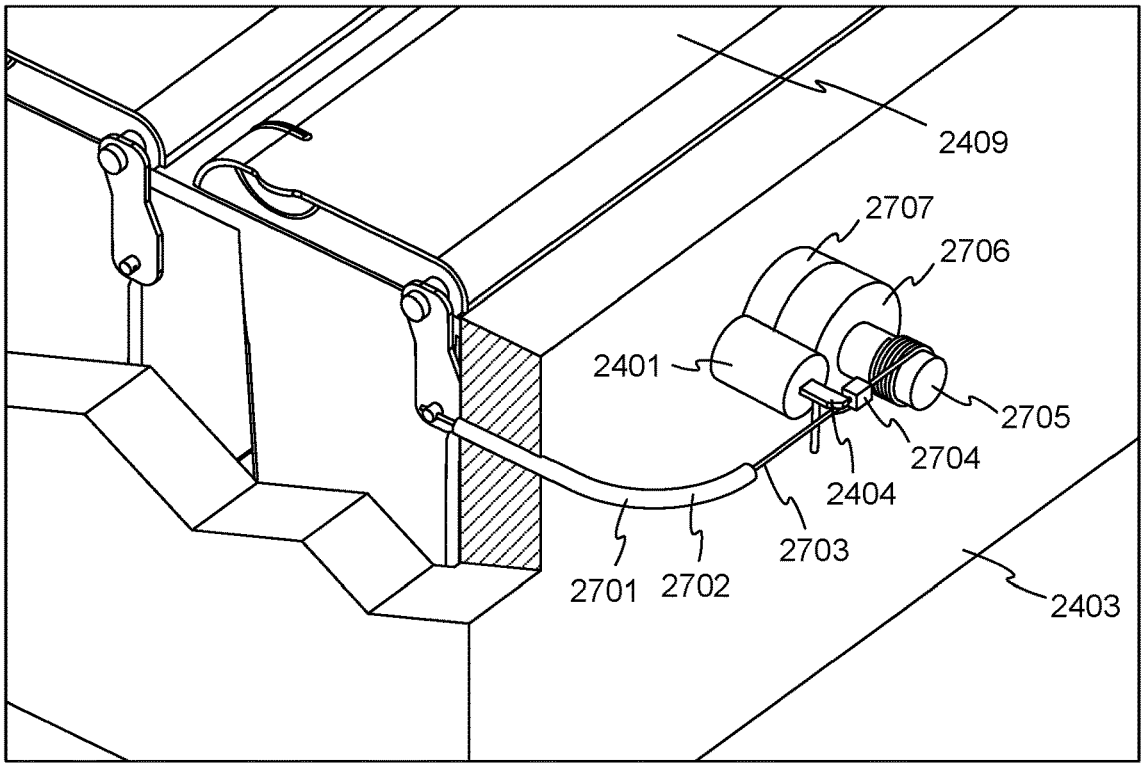
FIG. 27 illustrates another technique for locking and unlocking the lids of a dispense drawer, in accordance with other embodiments of the invention.

FIG. 27 illustrates another technique for locking and unlocking the lids of a dispense drawer, in accordance with other embodiments of the invention. Rather than using a mechanical linkage having rigid parts, the system of FIG. 27 uses a sheathed cable 2701 to connect lid 2409 to other components of the system. Sheathed cable 2701 includes a sheath 2702, which may penetrate and be fixed to insulation 2403. Sheathed cable 2701 also includes a movable inner wire or cable 2703, which can move axially within sheath 2702. Sheathed cable 2701 may be of the kind often used for bicycle shifter and brake cables. In FIG. 27, lid 2409 is in the closed position. A stop 2704 on cable 2703 is held behind plunger 2404 of solenoid 2401, so that lid 2409 is prevented from opening. The end portion of cable 2703 is wrapped around a capstan 2705, which in turn is connected with a constant force spring 2706 and a rotary encoder 2707. Constant force spring 2706 maintains tension on cable 2703, holding lid 2409 in its closed position.

Upon receipt of a command to unlock lid 2409, solenoid 2401 is energized to retract plunger 2404. The user can then lift lid 2409 against the tension of constant force spring 2706, and retrieve the desired item from the compartment under lid 2409. Encoder 2707 may send signals to the controller indicating the position of capstan 2705, and therefore also the position of lid 2409. In other embodiments, a simple optical interrupter or other binary sensor may be used. An encoder such as encoder 207 may have the advantage that the encoder reading for the closed position of the lid can be recorded after each use, for example when the drawer is returned to the inside of the cabinet. This way drift from the cable length or other effects can be accommodated, for example in firmware.

Figure 28:
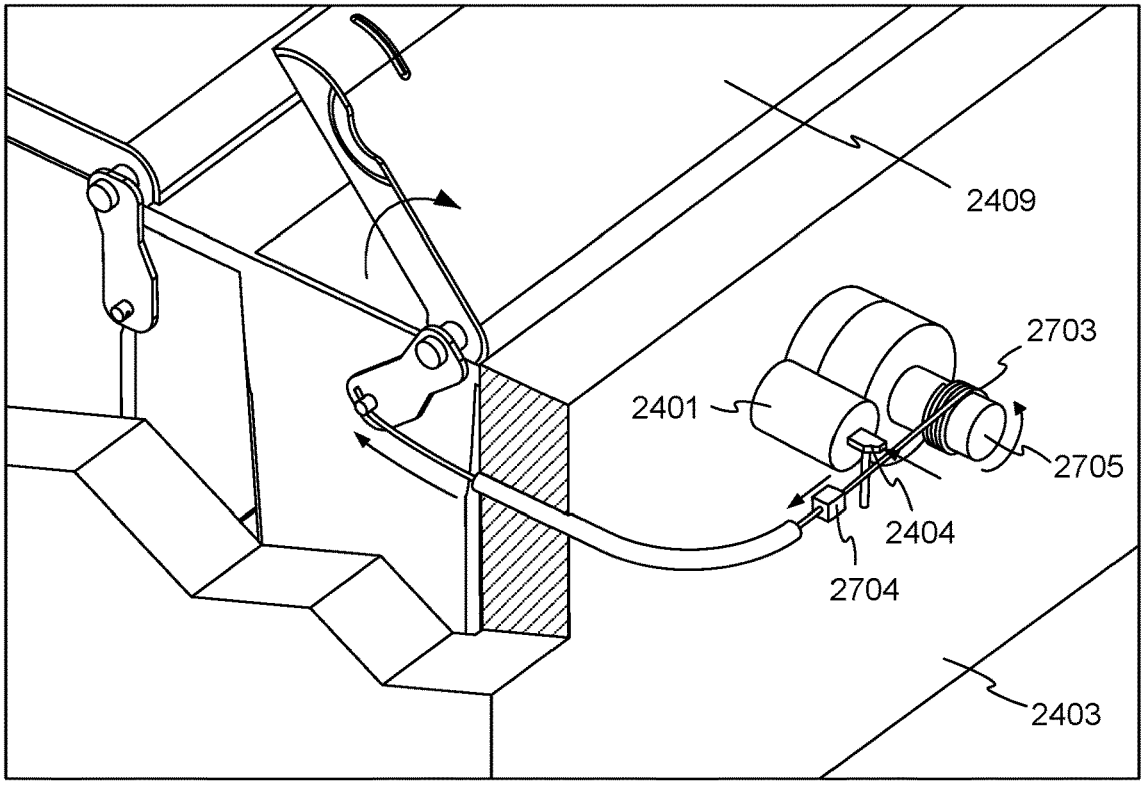
FIG. 28 shows the system of FIG. 27 with a lid in an open position.

FIG. 28 shows the system of FIG. 27 with lid 2409 in an open position. Plunger 2404 of solenoid 2401 has been retracted, permitting stop 2704 to pass plunger 2404 as lid 2409 is opened. Some of cable 2703 has unwound from capstan 2705. When the user closes lid 2409, spring 2706 helps retract cable 2703. Stop 2704 may come to rest behind plunger 2404, preventing lid 2409 from opening until another actuation of solenoid 2401. Preferably, each lid 2409 has a mechanical detent that holds the lid in its open position, despite any tension induced in cable 2703 by spring 2706.

While only one solenoid 2401 and sheathed cable 2701 are shown in FIGS. 27 and 28, it will be understood that a similar arrangement may be provided for any lockable lids of the dispense drawer. In addition, support structures, fasteners, and other items have been omitted from FIGS. 27 and 28 for clarity of illustration.

The system of FIGS. 27 and 28, using a sheathed cable such as sheathed cable 2701, may have the advantage that sheath 2702 need not move with respect to insulation 2403, and therefore can be tightly sealed to insulation 2403. In addition, the flexibility of sheathed cable 2701 may provide design freedom in the positioning of other components, for example solenoids 2401 or other actuators.

Figure 31:
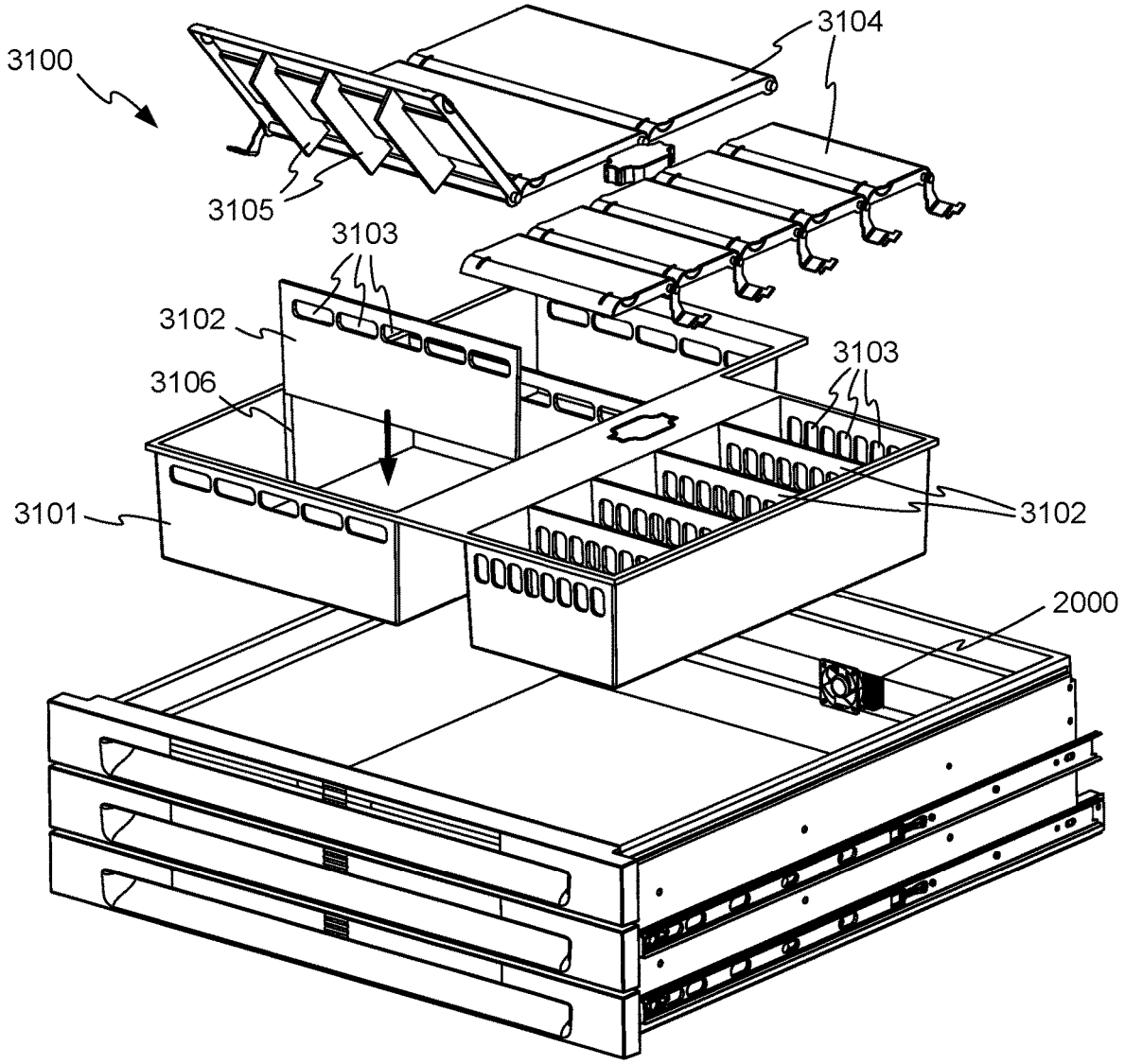
FIG. 31 illustrates a refrigerated drawer in in accordance with other embodiments of the invention.

FIG. 31 illustrates an exploded view of a refrigerated drawer 3100 in accordance with other embodiments of the invention. In some of the above embodiments, for example as shown in FIGS. 14 and 15, individual actuators are placed alongside each of the compartments in the drawer. This may result in the compartments being spaced apart from each other in the front-to-back direction of the drawer with unused space between them, as is visible in FIG. 22. The use of a remote actuator of the type shown in FIG. 24 or FIG. 27 may enable the compartments to be closer together, resulting in more usable storage space in drawer 3100 as compared with some other embodiments.

In the example embodiment of FIG. 31, the bins are formed by a tray 3101 having simple, thin dividers 3102. Dividers 3102 may slide into grooves or notches 3106 in tray 3101, or may be positioned in some other way. Dividers 3102 may be permanently fixed to tray 3101, for example by solvent bonding or a permanent snap fit, or may be removable. In other embodiments, tray 3101 may be formed with integral dividers, for example by injection molding.

Tray 3101 and dividers 3102 may preferably be perforated by openings such as openings 3103, so that air can circulate within drawer 3100, passing through the walls and compartments in tray 3101. Lids 3104 of drawer 3100 may include descending ribs 3105 that protrude into the compartments when lids 3104 are closed. Ribs 3105 thus prevent complete filling of the compartments. The top portions of the compartments remain substantially open, permitting airflow throughout drawer 3100.

Lids 3104 may be positioned more closely together in the front-to-back direction of drawer 3100 than in some other embodiments. The thinness of dividers 3102 permits the resulting compartments within tray 3101 to be larger than in other embodiments, increasing the storage capacity of drawer 3100.

Figure 32:
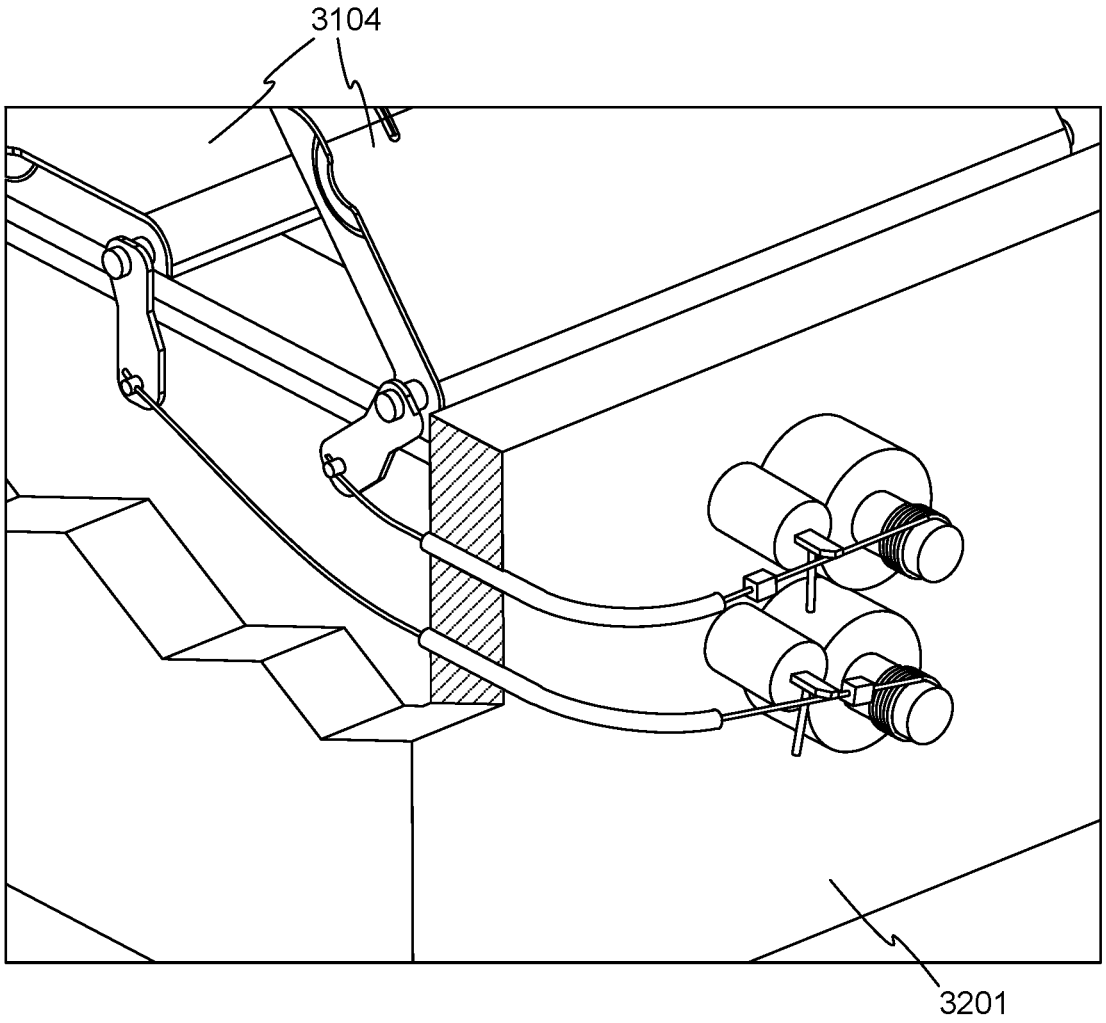
FIG. 32 illustrates how two actuators may be mounted outside of insulation in a drawer according to embodiments of the invention.

FIG. 32 illustrates how two actuators may be mounted outside of insulation 3201 of drawer 3100, to actuate two of lids 3104.

Figure 33:
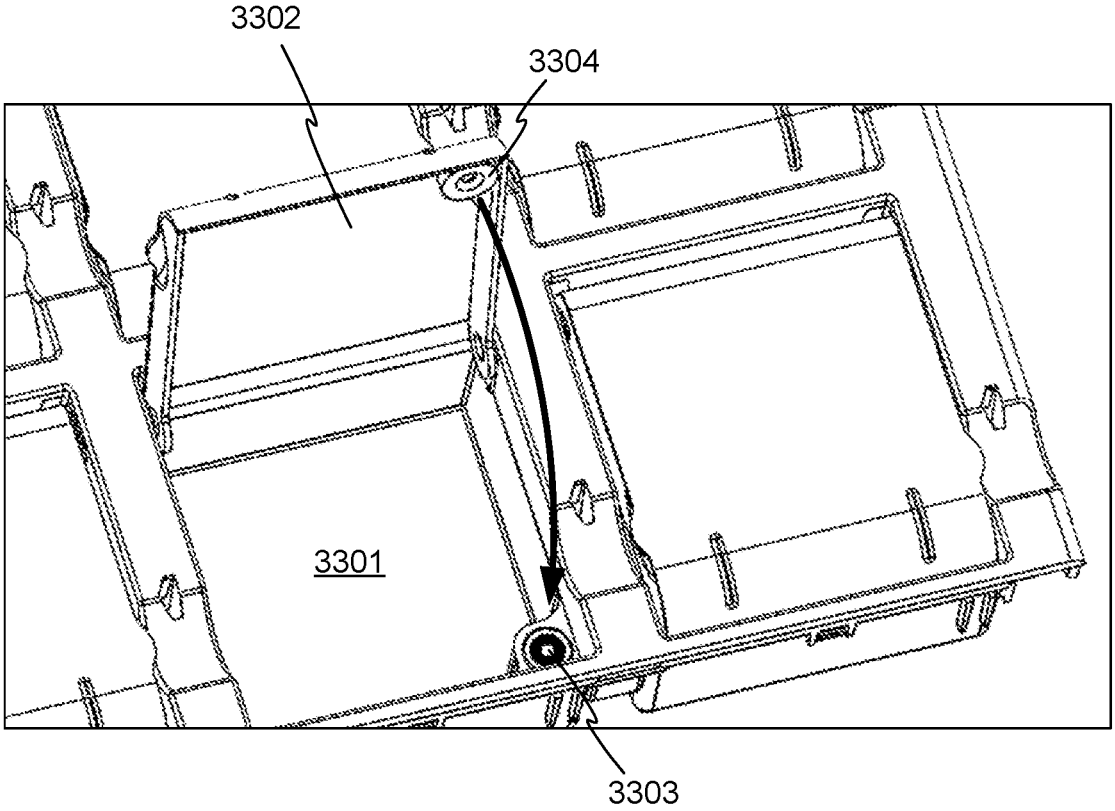
FIG. 33 illustrates a compartment having a lid and a magnetic latch, in accordance with embodiments of the invention.

In other embodiments, a magnetic latching system may be used for lids in a refrigerated drawer. FIG. 33 illustrates a compartment 3301 having a lid 3302. An electromagnet 3303 is mounted at one corner of compartment 3301, and a permanent magnet 3304 is mounted in lid 3302. When lid 3302 is closed, permanent magnet 3304 is positioned over and preferably in contact with electromagnet 3303. In the absence of current through electromagnet 3303, lid 3302 is held closed by the magnetic attraction between permanent magnet 3304 and electromagnet 3303. Permanent magnet 3304 is preferably strong enough that lid 3302 can be considered locked. For example, permanent magnet 3304 may be attracted to electromagnet 3303 with a force of up to five pounds or more, making it difficult to open lid 3302 without tools.

To unlock lid 3302, a controller such as controller 103 causes current to flow through electromagnet 3303 in a direction to cause a repelling force against permanent magnet 3304. With sufficient current, the attraction of permanent magnet 3304 to electromagnet 3303 is overcome, and lid 3302 can be easily lifted. In some embodiments, the current level may be selected to be slightly smaller than the current needed to completely overcome the attractive force, so that lid 3302 can be opened with only a small amount of lifting force. In other embodiments, the current is high enough to completely overcome the attraction between the two magnets, and lid 3302 may open due to the repelling force of electromagnet 3303.

In some embodiments, the positions of electromagnet 3303 and permanent magnet 3304 could be reversed. In other embodiments, no permanent magnet may be needed. Rather, permanent magnet 3304 may be replaced by a simple plate made of a ferromagnetic material, and lid 3302 may be locked by passing current through electromagnet 3303. To unlock lid 3302 in this arrangement, the current flow is simply stopped. However, while this alternate arrangement may be workable, it has the disadvantage of drawing current at all times except when lids are unlocked. In addition, the lids may unlock during a power failure. In the preferred embodiment of FIG. 33, including permanent magnet 3304, the lids are locked by default, and do not draw current in their locked state.

As is mentioned above, it may be possible to force lid 3302 open from its locked state using tools. Preferably, a detection circuit is provided to detect such intrusions. For example, a Hall effect sensor may be positioned near electromagnet 3303, so as to detect the magnetic field of permanent magnet 3304 when lid 3302 is closed. If the sensor detects that the magnetic field has disappeared (or sufficiently diminished) while electromagnet 3303 is not energized, it may be assumed that lid 3302 has been pried open, and an alarm or warning may be issued. For example, an audible alarm may be sounded at the cabinet site, or an electronic message may be forwarded via controller 103 to an appropriate contact for investigation.

In other embodiments, electromagnet 3303 may be loosely mounted to compartment 3301, so that lid 3302 can be lifted slightly while compartment 3301 remains locked. The permitted travel is preferably sufficient to be detected by any detection circuit, but not sufficient to allow access to the locked compartment. This capability may be used during a "restock" mode. A user authorized to do so, for example a pharmacy technician tasked with restocking the compartments, may place the cabinet in the restock mode. In this mode, lifting one of the lids slightly signals the controller, via the sensor, that the technician wishes to open that particular compartment for restocking. The controller then unlocks the compartment. This capability allows the restock technician to quickly open compartments as needed, without having to enter information into the controller. Once restocking is complete, the technician preferably terminates the restock mode, so that the compartments remain locked until dispensing of items is properly requested by a user.

The arrangement of FIG. 33 positions at least some electrical or electronic components within the refrigerated space. For example, electromagnet 3303 is within the refrigerated drawer, and may be mounted to a printed circuit board under compartment 3301. The board may also hold any closure sensors, lights, or other elements. Preferably, any printed circuit board and associated electronic components are encapsulated with a waterproof conformal coating to avoid degradation or damage due to moisture condensation.

It is to be understood that all workable combinations of the features disclosed herein are also considered to be disclosed.

The invention has now been described in detail for purposes of clarity and understanding. However, it will be appreciated that certain changes and modifications may be practiced within the scope of the appended claims.

What is claimed is:

1. A device for dispensing items, comprising:

a cabinet;

a drawer within the cabinet, the drawer including one or more compartments for storing items, wherein the drawer comprises an outer shell and thermal insulation inside of the outer shell at sides of the drawer and beneath the one or more compartments; and a cooling system within the drawer, the cooling system comprising a fan configured to both exhaust heat from the cooling system and cause airflow inside of the drawer and between the outer shell and the thermal insulation of the drawer, the cooling system configured to maintain the one or more compartments in the drawer at a temperature below a temperature of the environment surrounding the cabinet.

2. The device of claim 1, wherein the cooling system comprises a compressor, a condenser, and an evaporator.

3. The device of claim 1, wherein the cooling system is a thermoelectric cooling system.

4. The device of claim 3, wherein the thermoelectric cooling system further comprises a fan configured to circulate air within the drawer.

5. The device of claim 4, wherein at least some of the one or more compartments are defined in part by perforated walls that permit circulating air to pass through the walls and through the compartments.

6. The device of claim 5, wherein lids of at least some of the compartments that are defined in part by perforated walls include descending ribs that protrude into the compartments so defined when the lids are closed.

7. The device of claim 3, further comprising a computerized controller coupled to the drawer, the controller controlling access to the drawer.

8. The device of claim 7, further comprising a temperature probe within the drawer, wherein the temperature probe provides a signal to the computerized controller indicating a temperature within the drawer.

9. The device of claim 7, further comprising one or more actuators controllable by the computerized controller and coupled to lids of respective ones of the one or more compartments, wherein the one or more actuators are disposed outside of an interior of the drawer defined by the thermal insulation at the sides of the drawer and the thermal insulation beneath the one or more compartments.

10. The device of claim 9, further comprising magnetic latches on at least some of the compartments, the magnetic latches controlled by the computerized controller to lock and unlock the lids of their respective compartments.

11. The device of claim 10, wherein each of the magnetic latches comprises a permanent magnet fixed to the lid of the respective compartment, and an electromagnet fixed to a wall of the compartment such that the permanent magnet contacts the electromagnet when the lid is closed;

and wherein the controller unlocks the compartment by causing current to pass through the electromagnet, causing the electromagnet to repel the permanent magnet.

12. The device of claim 9, wherein the one or more actuators comprise one or more solenoids.

13. The device of claim 9, further comprising one or more sensors configured to sense the positions of lids of respective ones of the one or more compartments.

14. The device of claim 13, wherein each of the sensors is disposed outside of the interior of the drawer defined by the thermal insulation at the sides of the drawer and the thermal insulation beneath the one or more compartments, and is coupled to its respective lid.

15. The device of claim 14, wherein each of the sensors is coupled to its respective lid via a linkage that passes through the thermal insulation at the sides of the drawer or passes through the insulation beneath the one or more compartments.

16. The device of claim 14, wherein each of the sensors is coupled to its respective lid via a sheathed cable that passes through the thermal insulation at the sides of the drawer or passes through the insulation beneath the one or more compartments.

17. The device of claim 9, further comprising one or more lights corresponding respectively to at least some of the one or more compartments, and wherein the controller is configured to, upon determination that a particular compartment is to be accessed:

actuate one of the actuators corresponding the particular compartment to unlock the particular compartment; and illuminate one of the lights corresponding to the particular compartment.

18. The device of claim 9, further comprising an override mechanism accessible from outside the drawer, the override mechanism mechanically moving the one or more actuators to unlock one or more of the compartments manually.

19. The device of claim 3, wherein the thermoelectric cooling system comprises a closed cooling loop containing a heat transfer fluid.

20. The device of claim 19, wherein the heat transfer fluid is maintained at a pressure such that its boiling point is at approximately a desired temperature of the inside of drawer.

21. The device of claim 20, wherein the heat transfer fluid is maintained at a pressure such that its boiling point is between 2° C. and 8° C.

22. The device of claim 19, wherein the heat transfer fluid is carbon dioxide.

23. The device of claim 19, wherein the thermoelectric cooling system, including the closed cooling loop and the heat transfer fluid, forms a heat pipe that operates by natural convection.

24. A drawer, comprising:

an outer shell;

insulation defining a climate-controlled interior of the drawer;

a thermoelectric cooling system disposed in a side wall of the drawer and configured to maintain interior of the drawer at a temperature below the temperature of the environment surrounding the drawer, the thermoelectric cooling system comprising a fan configured to both exhaust heat from the cooling system and cause airflow inside of the drawer and between the insulation of the drawer and the outer shell;

a set of walls defining one or more compartments within the climate-controlled interior of the drawer;

one or more lids covering the one or more compartments;

an electrical interface for receiving power and control signals; and one or more actuators coupled to the one or more lids for locking and unlocking the one or more compartments in response to control signals received via the electrical interface.

25. The drawer of claim 24, wherein the one or more actuators are disposed outside the climate-controlled interior of the drawer.

26. The drawer of claim 24, further comprising one or more lights corresponding to the one or more compartments, the lights being responsive to control signals received via the electrical interface.

27. The drawer of claim 24, wherein the thermoelectric cooling system is configured to circulate cooled air in the interior of the drawer.

28. The drawer of claim 24, wherein the thermoelectric cooling system includes a closed cooling loop containing a heat transfer fluid.

29. The drawer of claim 28, wherein the heat transfer fluid is carbon dioxide maintained at a pressure such that its boiling point is between 2° C. and 8° C.

* * * * *